US011338321B2

(12) United States Patent
Yu et al.

(10) Patent No.: US 11,338,321 B2
(45) Date of Patent: May 24, 2022

(54) METHOD FOR MODIFYING COATED RAZOR BLADE EDGES

(71) Applicant: The Gillette Company LLC, Boston, MA (US)

(72) Inventors: Weili (Nancy) Yu, Medfield, MA (US); Neville Sonnenberg, Newton, MA (US); John Chadwick, Pelham, NH (US); John Lawrence Maziarz, Framingham, MA (US)

(73) Assignee: The Gillette Company LLC, Boston, MA (US)

( * ) Notice: Subject to any disclaimer, the term of this patent is extended or adjusted under 35 U.S.C. 154(b) by 342 days.

(21) Appl. No.: 16/407,715

(22) Filed: May 9, 2019

(65) Prior Publication Data

US 2020/0353504 A1 Nov. 12, 2020

(51) Int. Cl.

| | |
|---|---|
| ***B05D 3/12*** | (2006.01) |
| ***B05D 1/02*** | (2006.01) |
| ***B05D 3/02*** | (2006.01) |
| ***B05B 15/00*** | (2018.01) |
| ***B26B 21/60*** | (2006.01) |

(52) U.S. Cl.

CPC ..... *B05D 3/12* (2013.01); *B05B 15/00* (2013.01); *B05D 1/02* (2013.01); *B05D 3/0254* (2013.01); *B26B 21/60* (2013.01); *Y10S 76/08* (2013.01)

(58) Field of Classification Search

CPC . B05D 3/12; B05D 15/00; B05D 1/02; B05D 3/0254; B05D 1/42; B05D 5/08; B05D 2202/00; B05D 1/40; B26B 21/54; B26B 21/58; B26B 21/60; B23P 15/403; B21D 53/645; Y10S 76/08

See application file for complete search history.

(56) References Cited

U.S. PATENT DOCUMENTS

| | | | |
|---|---|---|---|
| 3,071,856 | A | 1/1963 | Fischbein |
| 3,949,067 | A | 4/1976 | Gibbs |
| 4,820,884 | A | 4/1989 | Weigert |
| 5,384,345 | A | 1/1995 | Naton |
| 5,477,756 | A | 12/1995 | Trankiem et al. |

(Continued)

FOREIGN PATENT DOCUMENTS

| | | | |
|---|---|---|---|
| CN | 1910018 | A | 2/2007 |
| EP | 1704026 | A1 | 9/2006 |

(Continued)

OTHER PUBLICATIONS

All Office Actions, U.S. Appl. No. 15/431,553.

(Continued)

*Primary Examiner* — William P Fletcher, III

(74) *Attorney, Agent, or Firm* — Joanne N. Pappas; Kevin C. Johnson

(57) ABSTRACT

A method of modifying razor blade edges prior to a first use, the method comprising providing at least one razor blade having a coated razor blade edge, and mechanically modifying at least one coating of said coated razor blade edge. Also provided is an apparatus for modifying one or more coated razor blade edges, the apparatus comprising a support member for holding a plurality of razor blades with said coated razor blade edges, and an applicator for contacting a mechanical modifying material with at least a section of said coated razor blade edges.

15 Claims, 13 Drawing Sheets

(56) References Cited

U.S. PATENT DOCUMENTS

| | | | | |
|---|---|---|---|---|
| 5,985,459 | A | 11/1999 | Kwiecien et al. | |
| 7,060,367 | B2 * | 6/2006 | Yamada | B26B 21/56 30/346.53 |
| 10,011,030 | B1 | 7/2018 | Slattery et al. | |
| 10,766,157 | B2 | 9/2020 | Chadwick et al. | |
| 2002/0043334 | A1 | 4/2002 | Johnson | |
| 2002/0161014 | A1 | 10/2002 | Sadhu et al. | |
| 2005/0155460 | A1 | 7/2005 | Trankiem | |
| 2007/0044248 | A1 | 3/2007 | Bratescu et al. | |
| 2007/0062047 | A1 | 3/2007 | Zhuk | |
| 2007/0227009 | A1 | 10/2007 | Zhuk et al. | |
| 2014/0101945 | A1 * | 4/2014 | Wang | C08J 7/00 30/346.53 |
| 2016/0001456 | A1 | 1/2016 | Duff, Jr. et al. | |
| 2016/0096281 | A1 | 4/2016 | Hejmowski et al. | |
| 2016/0096282 | A1 * | 4/2016 | Doyle | B05D 3/12 30/346.53 |
| 2016/0239727 | A1 | 8/2016 | Trissel et al. | |
| 2018/0230320 | A1 | 8/2018 | Chadwick et al. | |
| 2020/0338771 | A1 | 10/2020 | Chadwick et al. | |
| 2020/0391398 | A1 | 12/2020 | Chadwick et al. | |
| 2021/0252727 | A1 * | 8/2021 | Pan | B05D 5/083 |

FOREIGN PATENT DOCUMENTS

| | | | | |
|---|---|---|---|---|
| EP | 3616800 | A1 * | 3/2020 | B05D 3/007 |
| EP | 3616800 | A1 | 3/2020 | |
| GB | 1230567 | A | 5/1971 | |
| WO | 2010081119 | A1 | 7/2010 | |

OTHER PUBLICATIONS

All Office Actions, U.S. Appl. No. 15/431,566.
All Office Actions, U.S. Appl. No. 16/928,502.
All Office Actions, U.S. Appl. No. 16/932,282.
https ://www.chemicalbook.com/Chemical ProductProperty EN_ 0827 52208 .htm (Year: 2017).
International Search Report and Written Opinion; Application Ser. No. PCT/US2020/032294; dated Sep. 1, 2020, 20 pages.
Parr Instrument Company. "Series 4560 Mini Reactors, 100-600 ml" https://www.parrinst.com/products/stirred-reactors/series-4560-100-600-ml-mini-reactors/» Nov. 28, 2011, last viewed Oct. 8, 2021. (Year: 2011).

* cited by examiner

As sintered (virgin)

TUT Blade (reference)

METHOD FOR MODIFYING COATED RAZOR BLADE EDGES

FIELD OF THE INVENTION

The invention generally relates to treatment of coated razor blade edges, and more particularly to mechanical modification of a coating on the coated razor blade edges.

BACKGROUND OF THE INVENTION

It is generally known that uncoated razor blades can cause discomfort due to the excessive force required to draw the cutting edge of the blade through beard hairs or other types of hair fibers. The addition of a fluoropolymer blade coating dramatically reduces the cutting forces, which improves shaving attributes including safety, closeness, and comfort. One of the most common fluoropolymers utilized for coating razor blades is polytetrafluoroethylene (PTFE). Coated razor blades are described in U.S. Pat. Nos. 3,071,856 and 3,203,829

There are many types of processes that may be utilized to produce a PTFE (e.g., telomer) coating on blade edges. However, regardless of the method by which the coating is produced, a non-uniform surface morphology, on a microscopic scale, is typically produced on the blade edge and in the area proximal to the blade tip due, at least in part, to the particle size dispersion of PTFE particles and by the wetting and spreading dynamics of dispersion. This lack of uniformity and sections of coating that are of different thicknesses can produce high initial cutting forces and a less comfortable shave during the first few uses of a new, coated razor blade, as compared to subsequent uses of the coated razor blade.

Previous efforts to achieve a PTFE coating of optimal thickness and uniformity include adjusting the coating process such as selection of different PTFE dispersions, modification of the surfactant used in the dispersion, optimization of the spray and/or sintering conditions, and post-coating treatment such as thinning the PTFE coating via use of FLUTEC® technology as described in U.S. Pat. No. 5,985,459. Modification of the coating process has met with some success. While treatment of coated blades with solvents has been largely successful, chemical treatment has a number of disadvantages and limitations, including the need to perform additional post-treatment steps and creation of chemical waste.

Thus, there is a need for improved, effective methods and apparatuses to produce a razor blade edge with improved shaving attributes, particularly for a first use of the razor blade.

SUMMARY OF THE INVENTION

In accordance with an aspect of the present disclosure, a method of modifying razor blade edges is provided, the method comprising: providing at least one razor blade having a coated razor blade edge; and mechanically modifying a coating of said coated razor blade edge.

In accordance with another aspect of the present disclosure, an apparatus for modifying one or more coated razor blade edges is provided, the apparatus comprising: a support member for holding a plurality of razor blades with said coated razor blade edges; and an applicator for contacting a mechanical modifying material with at least a section of said coated razor blade edges.

In accordance with a further aspect of the present disclosure, a method of modifying razor blade edges prior to a first use, the method comprising: providing at least one razor blade having a coated razor blade edge; and wiping said coated razor blade edge with at least one mechanical modifying material.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
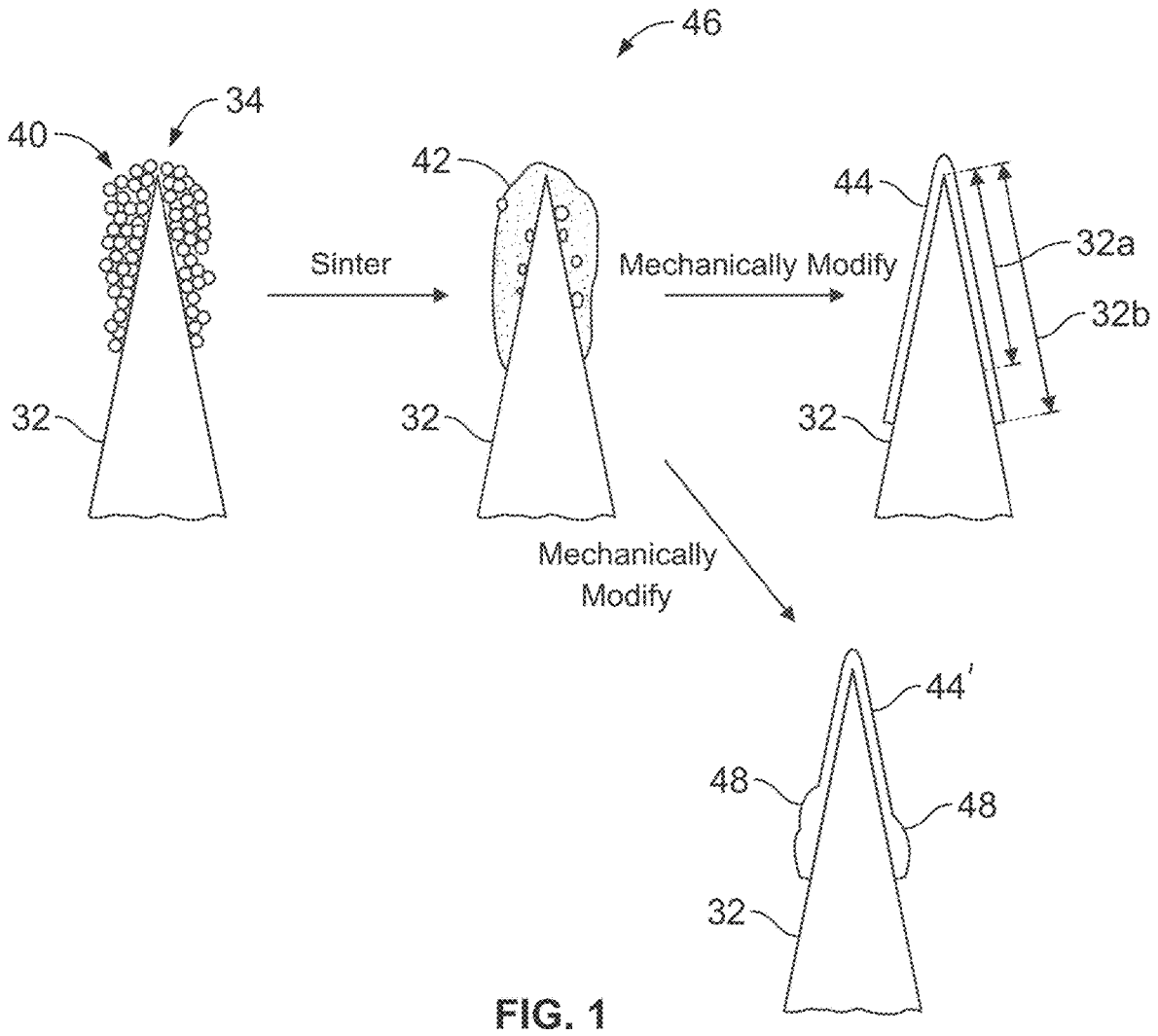
FIG. 1 is a flow diagram depicting modification of an outer coating of an individual razor blade edge.

A razor blade typically is formed of suitable substrate material such as metal or ceramic. For example, stainless steel razor blades are commonly used. An edge is formed in the razor blade with a wedge-shape configuration having an ultimate edge or tip. As used herein, the terms "razor blade edge" or "razor blade cutting edge" or "blade edge" include the cutting point and facets of the razor blade.

Razor blades may include one or more layers of supplemental coating material for shave facilitation, and/or to increase the hardness, strength, and/or corrosion resistance of the blade edge. These coating materials may include, for example, polymeric materials, metals, and alloys, as well as other materials including diamond and diamond-like carbon material. As used herein, the term "outer coating" refers to the final coating applied to the razor blade, specifically the razor blade cutting edge, which generally comprises a polymer coating. In some instances, the entire blade could be coated in the polymer coating in the manner described herein; however, such an enveloping coating is not believed to be essential to the present invention.

As used herein, the term "mechanical," and variations thereof, signifies utilizing a process involving a physical apparatus, machine, material, or instrument or the physical apparatus, machine, material, or instrument itself.

The term "modifying," and variations thereof, as used herein signifies partially or fully altering, treating, or thinning, and in particular, with respect to a surface (e.g., an outer coating).

The term "mechanical modification," and variations thereof, signifies modification of a surface (e.g., an outer coating) by physical contact between a mechanical modifying material and the surface.

Some examples of types of mechanical modification include actions of manual or automatic cutting or wiping in a particular direction with respect to the blade edge. The wiping action may comprise, for example, a rubbing, spreading, smearing, streaking, distributing, dabbing, sponging, swabbing, polishing, cleaning, or drying action, or any combination thereof. As will be described, the mechanical modifying material can be moving while the blade or blades is stationary or vice-versa, or both the mechanical modifying material and the blade or blades can be moving relative to each other. The direction of movement can be horizontal or vertical. For instance, a wiping mechanical modifying action can be thought to be run in a horizontal direction, similar to, but not limited only to, an action such as a butter knife running across the top surface of a pad of butter. In this way, a substantial portion of the outer surface of the mechanical modifying material or media is impacted. A cutting action can be achieved in the vertical direction or at an angle relative to the blade or blade edges where a generally small area or portion of the outer surface of the mechanically modifying material contacts and modifies the blade or blade edges. The angle at which the cutting action occurs in the present invention ranges from about 1 degree to about 90 degrees.

A wiping action may be contrasted with a cutting action, as cutting generally involves at least partial separation or detachment of one section of the mechanical modifying material from the other section of the mechanical modifying material.

The term "thinning," and variations thereof, as used herein includes, but is not limited to, at least partial removal of the material or at least partial reduction in a thickness of the material.

As used herein, the term "pushing back," "pushed back", "push back or "pushed back region" and variations thereof, includes relocation of at least a portion of a material away from the tip or edge of a razor blade and may also include some thinning of the material at the tip or edge. For instance, a "pushed back" coating generally results from a mechanically modified coating as used herein. Optimally, the pushed back region starts at about 25 micrometers or greater from the ultimate tip of the edge.

Methods for preparing a razor blade with a coated blade edge are described in detail in U.S. Pat. Nos. 5,263,256 and 5,985,459. With reference to the flow diagram 46 in FIG. 1, a dispersion containing polymer particles 40, e.g., a polyfluorocarbon such as 0.1 μm polytetrafluoroethylene (PTFE) particles, is prepared and applied to a razor blade edge 32 by, for example, spraying, dipping, vapor deposition, or any other suitable method. The dispersion may be applied on and around a tip 34 of the razor blade edge 32. The polymer particles 40 may be low molecular weight, e.g., a telomer. The coated blade edge 32 is sintered, e.g., at a temperature of about 330° C. to about 370° C., to produce a sintered polymer coating 42 that is adhered to the razor blade edge 32. The sintered polymer coating 42 may then be modified as described herein to form a novel outer coating 44, 44'.

Because the melt viscosity of polyfluorocarbons like PTFE can be extremely high, the polymer particles 40 do not form a smooth coating on the surface of the razor blade edge 32, as seen in FIG. 1. This non-uniform coating creates a phenomenon in which the first one or two shaves with a new, coated razor blade may result in reduced comfort for the user, as compared to subsequent shaves. This initially higher level of discomfort may be due, at least in part, to the user's sensitivity to the forces required to shave such a non-uniformly coated blade edge with edge 32 and tip 34.

In general, the thinner the polymer coating becomes on the blade edges, the lower the cutting force will be, assuming the coating is uniform. While a thin coating is generally desirable, a coating that is too thin, and not contiguous, can give rise to poor coverage and low wear resistance due to intrinsic properties of the PTFE material. Alternatively, a coating that is too thick may produce very high initial cutting forces, which generally may lead to more drag, pull, and tug, eventually losing cutting efficiency and subsequently shaving comfort. Thus, there is a technical challenge to balance the attributes of the polymer material with obtaining the thinnest, densest, and most uniform polymer coating possible.

As described in U.S. Pat. Nos. 5,985,459 and 10,011,030, coated blade edges may be chemically treated with one or more chemical solvents to "thin" the telomer coating and provide razor blades with a polymer coating along the blade edge having a uniform thickness and demonstrating improved "first shave" cutting force. These solvents may include such as perfluoroalkanes, perfluorocycloalkanes, and/or perfluoropolyethers, and in particular, one or more FLUTEC® solvents. Solvent-treated blades have been shave-tested and demonstrate increases in shaving comfort.

However, solvent treatment has a number of drawbacks and disadvantages. One major drawback to the solvent treatment process is the creation of chemical waste from the initial solvent treatment step, as well as from one or more additional post-treatment cleaning steps that involve washing the treated blades with one or more additional solvents. While efforts are made to minimize the amount of solvent used and/or to reuse or recycle the solvent, some amount of solvent still must be disposed of as waste, which requires proper handling and disposal and contributes to cost. In addition, the chemical solvent can remove most of the polymer coating in some sections of the razor blade edge, which can result in a coating that is too thin and exhibits low wear resistance. The solvent-treated coatings may also exhibit porosity where the coating molecules are not sufficiently densely packed, making it difficult to achieve a coating with a desirable high density and uniformity. Another disadvantage of the chemical treatment process is that solvent-treated razor blades may exhibit increased corrosion of the blade body and the treated razor blade edges may develop rust.

The methods and apparatuses described herein involve mechanical modification of the polymer coating on a coated razor blade edge to produce a more uniform coating with a reduced initial or "first shave" cutting force, which translates to an improved first few shaves with fewer nicks, improved comfort, and/or improved closeness and often translates to improved subsequent shaves. Further, the mechanical modification of the present invention provides a blade without increased corrosion of the blade body, as mechanical modification is performed without the use of chemicals. In the present disclosure, blade attributes may be measured using various tests. Measuring cutting force correlates with sharpness of blades. The blade sharpness of the treated blades may be quantified by testing the blades for cutting force. Cutting force is determined by the wool felt cutter test, which measures the cutting force values of the blade by measuring the force required by each blade to cut through wool felt. Each blade is cut through a wool felt cutter five times, and the force of each cut (e.g., in pounds) is measured on a recorder. A cutting force is defined as the orthogonal or vertical force of the blade into the wool felt. The lowest of the five cuts is defined as the cutting force. In the present disclosure, wool felt cutter tests may be performed on the blades or a sample of the blades after each treatment or run. Other tests such as silicon oil drop tests and microscopy elevation evaluations are also contemplated in the present disclosure for determining blade attributes, as described below.

Figure 2A:
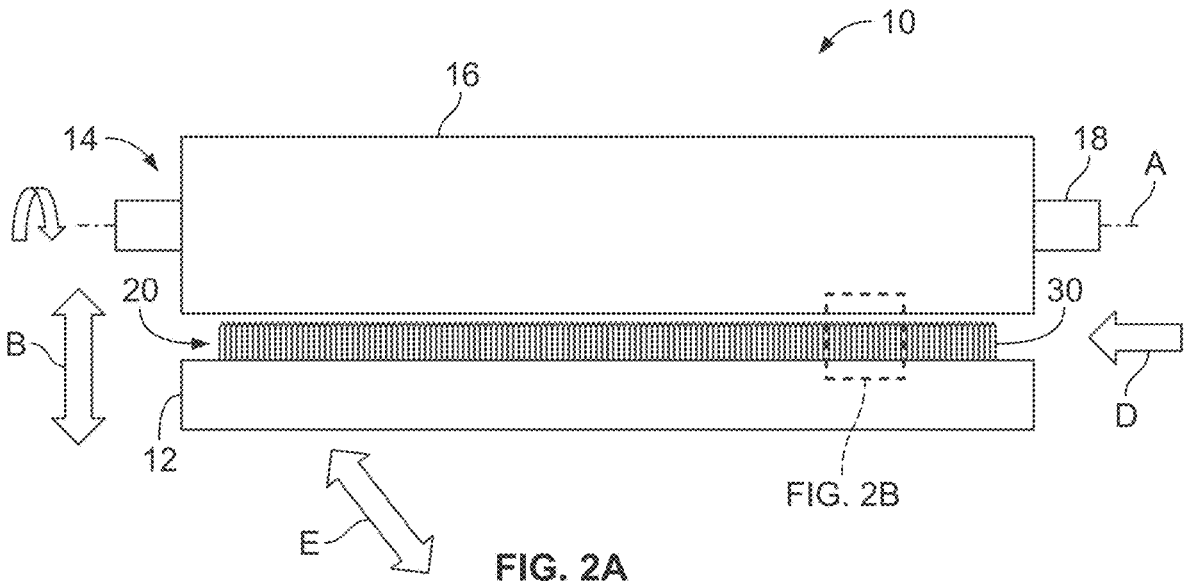
FIG. 2A is a side, diagrammatic view of an apparatus for carrying out a process of modifying one or more coated razor blade edges in accordance with the present disclosure.
Figure 2B:
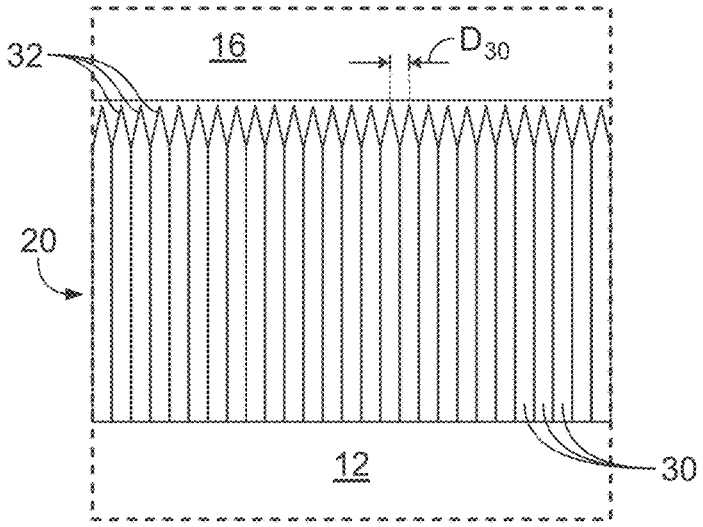
FIG. 2B is a detailed view of aspects of FIG. 2A illustrating individual razor blades.

FIGS. 2A, 3B, 3, and 4 are diagrammatic views of apparatuses 10, 100, 200 for carrying out a process of modifying one or more razor blade edges prior to a first use (e.g., a first shave of a consumer), in accordance with the present disclosure. The razor blade edges 32 comprise at least one coating that includes an outer coating on and around the tip 34 of the razor blade edge 32, as shown in FIG. 1. The outer coating may comprise, for example, a sintered polymer coating 42. With reference to FIGS. 2A and 2B, an apparatus 10 comprises at least one support member 12 and at least one applicator 14. The support member 12 holds a plurality of razor blades 30 each comprising a coated razor blade edge 32. The plurality of razor blades 30 may be arranged on one or more blade stacks 20 that are disposed on the support member 12, with the razor blade edges 32 aligned parallel to each other and facing outward from the support member 12. In some examples, the blade stack 20 may comprise several hundred or several thousand razor blades 30, e.g., up to 5,000 razor blades. The applicator 14 provides contact of a mechanical modifying material 16 with one or more sections or portions of the coated razor blade edges 32, as shown in the enlarged view of FIG. 2B and as described herein in detail. The applicator 14 may comprise at least one material support 18 on which the mechanical modifying material 16 is disposed. The material support 18 may be rotatable about an axis A. In this way, different portions of the mechanical modifying material 16 contact the razor blade edges 32.

Figure 3:
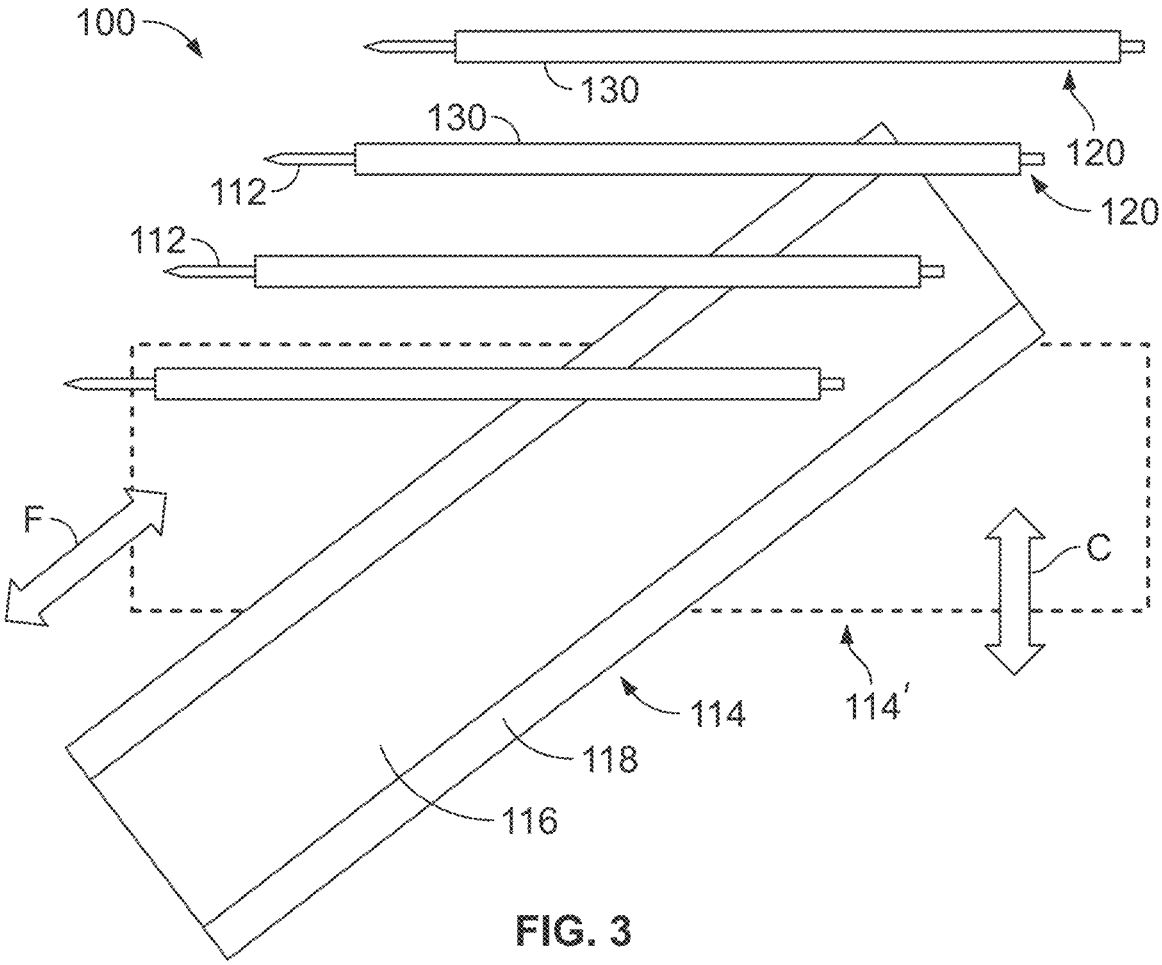
FIG. 3 is a top, diagrammatic view of an alternative apparatus for carrying out a process modifying one or more coated razor blade edges in accordance with the present disclosure.

FIG. 3 illustrates an alternative apparatus 100 comprising at least one applicator 114, 114' with at least one material support 118 that is non-rotatable and one or more support members 112 that each hold a plurality of razor blades 130. A mechanical modifying material 116 is disposed on the material support 118, and the razor blades 130 may be arranged on blade stacks 120 that are disposed on the one or more support members 112, with the coated razor blade edges (not shown; see FIG. 2B) being aligned parallel to each other and facing outward from the support member 112 (i.e., extending into the page toward the material support 118 and mechanical modifying material 116). Similar to FIGS. 2A and 2B, the applicator 114, 114' provides contact of the mechanical modifying material 116 with one or more sections or portions of the coated razor blade edges. In some examples, the applicator 114 may be disposed or oriented at an angle relative to the blade stacks 120. In other examples, the applicator 114' (shown in phantom) may be parallel to the blade stacks 120. In addition, while the blade stacks 120 are depicted in FIG. 3 as being offset with respect to each other, ends of the blade stacks 120 may also be aligned with each other (not shown).

Figure 4:
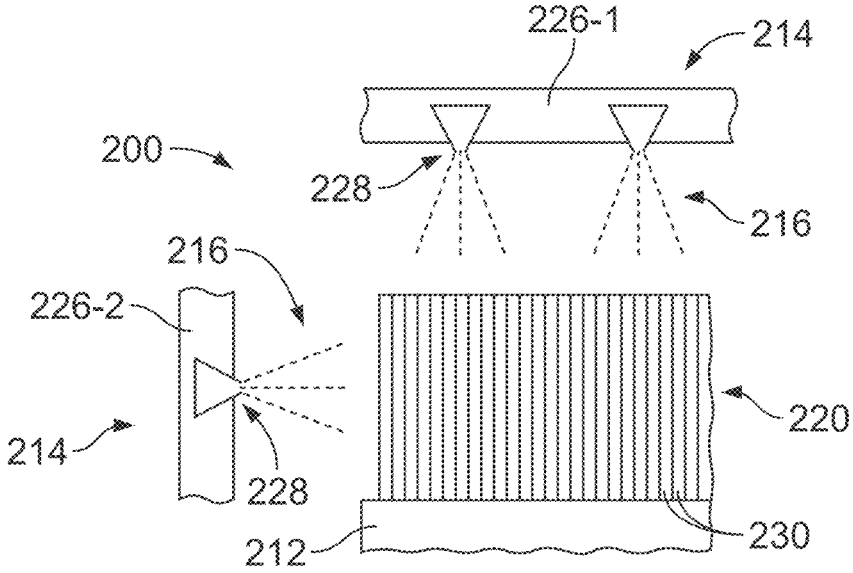
FIG. 4 is a side, diagrammatic view of another alternative apparatus for carrying out a process modifying one or more coated razor blade edges in accordance with the present disclosure.

A further alternative apparatus 200 is shown in FIG. 4, which is an enlarged, side view of a portion of an applicator 214 that comprises one or more fluid conduits 126-1, 126-2. The fluid conduits 126-1, 126-2 are positioned to dispense a mechanical modifying material 216 in the form of a fluid flow that contacts a plurality of razor blades 230 with coated razor blade edges (not labeled). The razor blades 230 may be arranged on one or more blade stacks 220 that are disposed on a support member 212, with the razor blade edges aligned parallel to each other and facing outward from the support member 212. Although not shown, one or more additional fluid conduits may be utilized to achieve the desired contact between the mechanical modifying material 216 and the coated razor blade edges.

Figure 5:
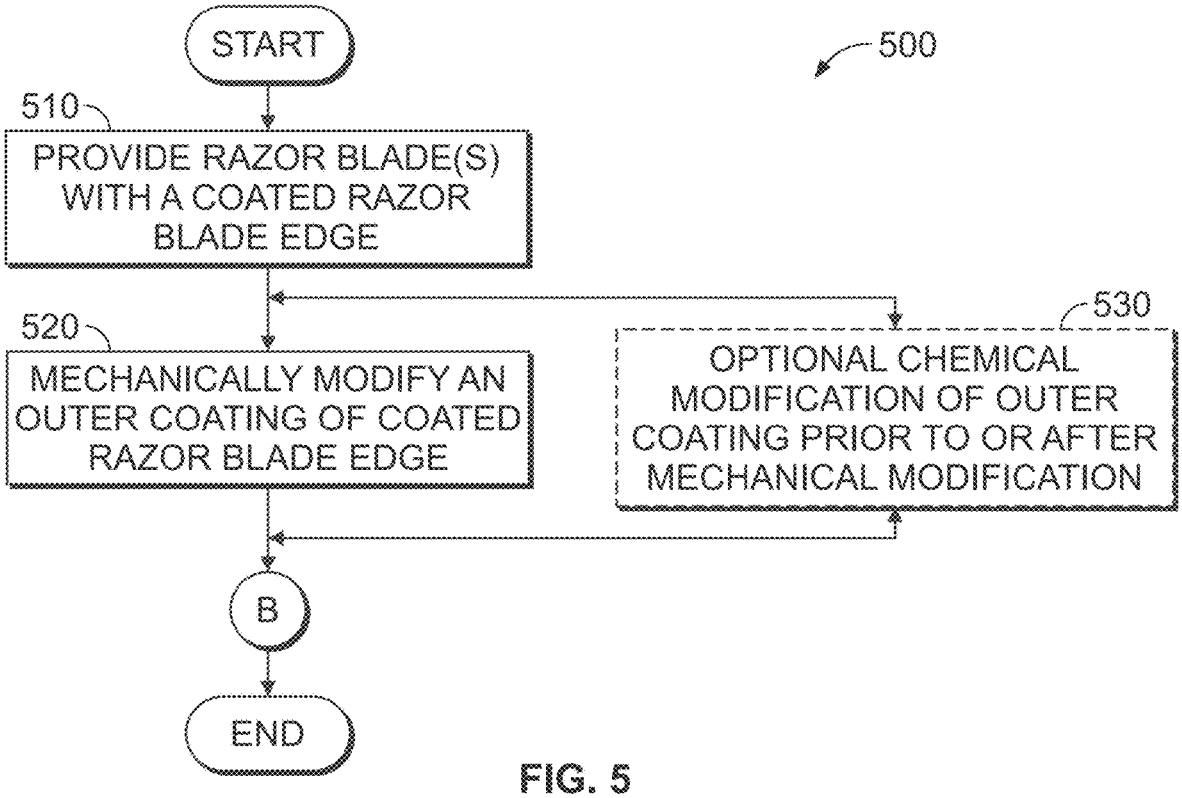
FIG. 5 is a flow diagram of a process of modifying one or more coated razor blade edges in accordance with the present disclosure.
Figure 6:
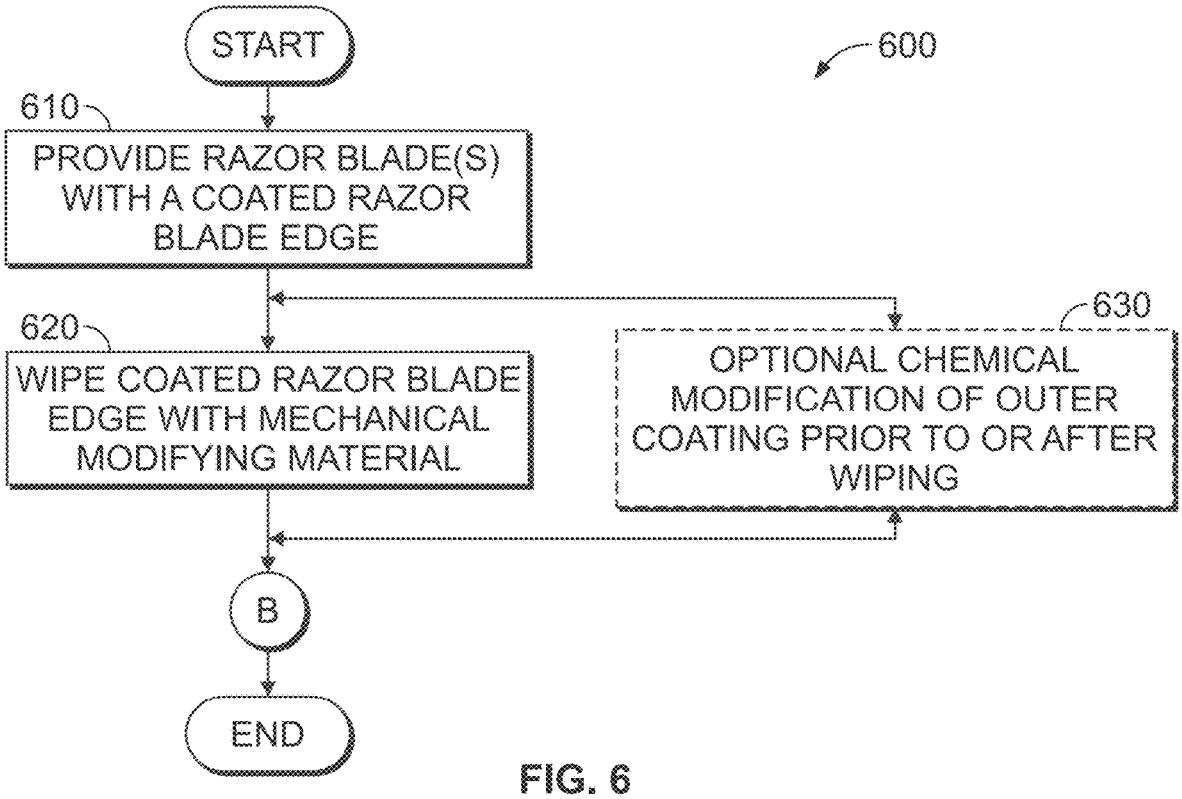
FIG. 6 is a flow diagram of an alternative process of modifying one or more coated razor blade edges in accordance with the present disclosure.
Figure 7:
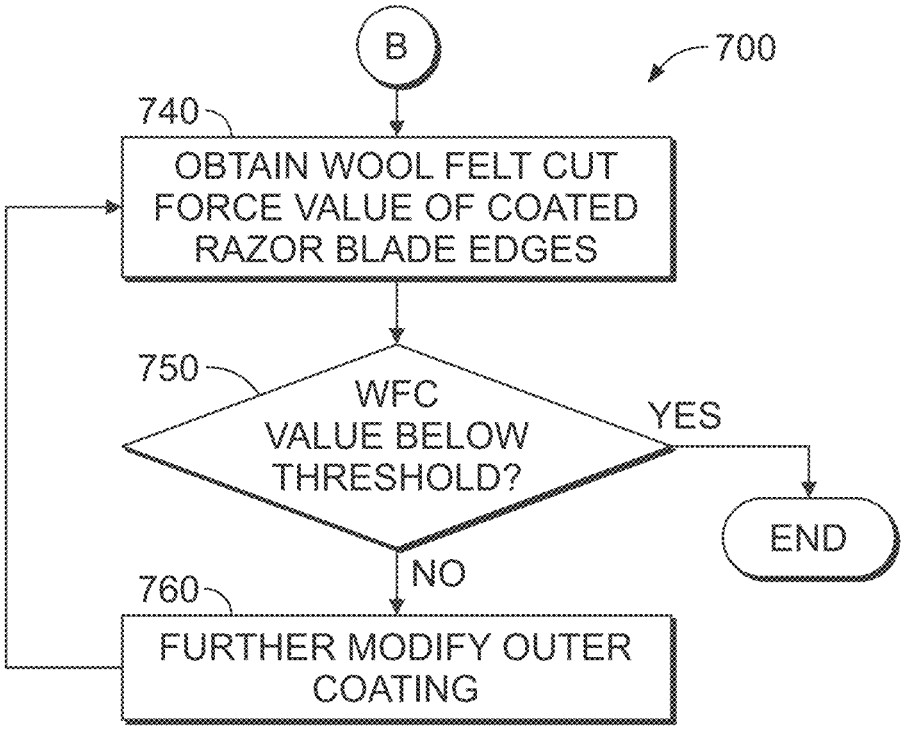
FIG. 7 is a flow diagram of an optional post-modification process in accordance with the present disclosure.

FIGS. 5-7 illustrate flow diagrams of the novel process of modifying one or more coated razor blade edges prior to a first use (e.g., a first shave of a consumer). These methods may be carried out by the apparatuses 10, 100, 200 depicted in FIGS. 2A, 2B, 3, and 4. With reference to FIGS. 1-6, one or more razor blades 30, 130, 230 with a coated razor blade edge 32 are provided, as indicated at step 510 of flow diagram 500 in FIG. 5 and step 610 of flow diagram 600 in FIG. 6. Each coated razor blade edge 32 comprises at least one coating, which may include an outer coating. This outer coating may comprise a polymer (e.g., a telomer), preferably a fluoropolymer, such as PTFE. Other outer coating and/or lubricious materials are contemplated in the present invention. Non-limiting examples include liquid-infused surface materials as described for instance in U.S. Patent Publication No. 2014/0360021, assigned to the Assignee hereof and herein incorporated by reference in its entirety. Providing the one or more razor blades 30, 130, 230 with a coated razor blade edge 32 may comprise, for example, spraying a dispersion, e.g., a dispersion comprising the polymer particles 40 in FIG. 1, on at least one uncoated razor blade to form a coated razor blade and prior to mechanical modification, sintering the coated razor blade to form the at least one razor blade with the outer coating, e.g., the sintered polymer coating 42 in FIG. 1, adhered to the coated razor blade edge 32 using the methods described herein. In some instances, the razor blades 30, 130, 230 with a coated razor blade edge 32 may be arranged on a blade stack 20, 120, 220, as described herein. The outer coating of the coated razor blade edges 32 is then mechanically modified, as indicated in step 520 of FIG. 5, which comprises contacting the coated razor blade edge 32 with one or more mechanical modifying materials 16, 116, 216. In particular, the coated razor blade edges 32 may be wiped with one or more mechanical modifying materials 16, 116, 216, as indicated in step 620 in FIG. 6.

As shown in FIGS. 2A, 2B, 3, and 4, the applicator 14, 114/114', 214 of each respective apparatus 10, 100, 200 is positioned such that the mechanical modifying material 16, 116, 216 is contacted with one or more sections or portions of the coated razor blade edges 32.

The mechanical modifying material of the present invention (e.g., 16, 116) may comprise one or more synthetic materials and/or natural materials and may comprise a solid material or a fluid. Synthetic materials may comprise, for example, one or more synthetic polymers or polymer-based materials. Natural materials may comprise animal-based and/or plant-based materials or materials derived from animals and/or plants, such as wood, paper and other cellulose-based materials, cork, animal hair, and the like. In some examples as shown in FIGS. 2A and 3, the mechanical modifying material 16, 116 may comprise a solid material including, but not limited to, a foam, wool felt, rubber, wood, paper (e.g., stacked paper sheets), textiles (e.g., non-woven fabrics), leather, elastomers, cork, one or more brushes, one or more cords, or any combination thereof. In instances in which the mechanical modifying material 16, 116 comprises a foam, the foam may comprise, for example, a polystyrene foam sheet, a foam sponge, or any combination thereof. A foam, such as polystyrene, is generally a low-density synthetic material and is not a hair-based material. Polystyrene is effective for the purpose of modifying the coated blade edges as despite it being less aggressive than other materials (e.g., brushes, rubber, wool felt, etc.), which may require more time and/or more mechanical actions to modify the blade coating, it generally provides a desirable resultant coating morphology on the blade after modification as will be disclosed herein.

In instances in which the mechanical modifying material 16, 116 comprises rubber, the rubber may be, for example, a silicon rubber or a natural rubber (e.g., isoprene or neoprene). In instances in which the mechanical modifying material 16, 116 comprises a leather, the leather may comprise, for example, a chamois leather. In other examples shown in FIG. 4, the mechanical modifying material 216 may comprise a fluid flow such as a pressurized fluid flow (e.g., a liquid such as water or alcohol), a slurry (e.g., a fluid with one or more particles), or any combination thereof, as described below in more detail.

In all examples, one or more portions of the applicator 14, 114/114', 214 and/or the support member 12, 112, 212 may be movable relative to each other so as to effect contact of the mechanical modifying material 16, 116, 216 with the coated blade edges 32, specifically with the outer coating, e.g., the sintered polymer coating 42, on the coated blade edges 32. The applicator 14, 114/114', 214 and/or the support member 12, 112, 212 may be movable relative to each other to adjust, for example, a distance between the coated razor blade edges 32 and a surface of the mechanical modifying material 16, 116, 216; an amount of force with which the mechanical modifying material 16, 116, 216 contacts the coated razor blade edges 32; a contact surface area between the mechanical modifying material 16, 116, 216 and the coated razor blade edges 32; and an angle of contact between the mechanical modifying material 16, 116, 216 and the coated razor blade edges 32.

For example, with reference to FIGS. 2A and 2B, the applicator 14 and/or the support member 12 may be adjustable in a direction indicated by arrow B to adjust the distance between the coated razor blade edges 32 and the surface of the mechanical modifying material 16 and the amount of force with which the mechanical modifying material 16 contacts the coated razor blade edges 32. This adjustment may also alter the contact surface area between the mechanical modifying material 16 and the coated razor blade edges 32. For example, the applicator 14 and/or support member 12 may be adjusted such that the mechanical modifying material 16 contacts substantially only the portion of the outer coating, e.g., the sintered polymer coating 42, at or near the ultimate tip 34 of the coated razor blade edge 32 (i.e., a smaller amount of contact surface area) or such that the mechanical modifying material 16 extends between adjacent ones of the razor blades 30 and contacts the portion(s) of the outer coating extending along the coated razor blade edges 32 toward the support member 12 (i.e., a larger amount of contact surface area; see also FIG. 1).

In all examples, the applicator 14, 114/114', 214 and/or the support member 12, 112, 212 may be movable such that contact between the coated blade edges 32 and the mechanical modifying material 16, 116, 216 occurs in a direction that is substantially parallel with the coated blade edges 32, as indicated by arrow C in FIG. 3; in a direction that is substantially perpendicular to the coated blade edges 32, e.g., at approximately a 90° angle in a direction indicated by arrow D in FIG. 2A; and/or at any angle therebetween, as indicated, for example, by arrows E and F in FIGS. 2A and 3. In instances in which a solid mechanical modifying material 16, 116 is used, the coated blade edges 32 may at least partially cut or wiped through the mechanical modifying material 16, 116. It may be desirable to orient the applicator 14, 114 and/or the support member 12, 112 such that the mechanical modifying material 16, 116 contacts the coated blade edges 32 at an angle so as to maximize the contact between the mechanical modifying material 16, 116 and the coated razor blade edges 32. Contacting the coated razor blade edges 32 at an angle may also help to prolong a usable life of the solid mechanical modifying material 16, 116. In addition, in all examples the applicator 14, 114/114', 214 and/or the support member 12, 112, 212 may be oriented substantially parallel to one another (e.g., applicators 14, 114', 214 in FIGS. 2A, 3, and 4) or at an angle (e.g., applicator 114 in FIG. 3).

The mechanical modifying material 16, 116 may be disposed on a material support 18, 118, as described herein. In some instances, the material support 18, 118 may be stationary. In other instances, the material support 18 may be rotatable. For example, as shown in FIG. 2A, the material support 18 may rotate about an axis A to further effect movement of the applicator 14 relative to the mechanical modifying material 16 and to effect contact of the mechanical modifying material 16 with the coated blade edges 32. The material support 18 may comprise a rotating wheel, a rotating block, a revolving tool, or a combination thereof. This rotational movement of the material support 18 may be used in place of, or in addition to, movement of the applicator 14 and/or the support member 12 in the direction indicated by any of arrows C-F.

Mechanically modifying the outer coating may comprise, for example, wiping the coated razor blade edges 32 with the mechanical modifying material 16, 116 or vice-versa, wiping the coated razor blade edges 32 onto or through the mechanical modifying material 16, 116 (also referred to herein as "a wiping action"). The wiping action may comprise, for example, a rubbing, spreading, smearing, streaking, distributing, dabbing, sponging, swabbing, polishing, cleaning, or drying action, or any combination thereof. The wiping action can be thought of as similar to, but not limited only to, actions such as a rag wiping down a table or a butter knife running across the top surface of a pad of butter.

In some instances, the wiping action may be performed substantially parallel to the coated razor blade edge 32, i.e., in the direction indicated by arrow C in FIG. 3. As described herein, the wiping action may cause the mechanical modifying material 16, 116 to contact a section or portion of the outer coating formed at the ultimate tips 34 of the coated razor blade edges 32, as shown in FIG. 1. Also as described herein, the mechanical modifying material 16, 116 may extend between the coated razor blade edges 32 of adjacent razor blades 30 to contact sections or portions of the outer coating formed on other areas of the coated razor blade edge 32, e.g., on sections/portions of the coated razor blade edge 32 located toward the support member 12, 112.

In some examples, mechanically modifying the outer coating may comprise contacting the coated razor blade edges 32 with one or more brushes. For example, the mechanical modifying material 16 in FIG. 2A may comprise one or more fine brushes made from one or more synthetic and/or natural materials. The brush(es) may comprise, for example, one or more synthetic polymeric materials such as PTFE, polypropylene, or nylon or one or more natural materials such as pig or horse hair and may comprise bristles with a diameter of between about 20 to 200 μm. The brush(es) may rotate, such that the bristles of the brushes contact the coated blade edges 32 in a direction indicated by any of arrows C-F. The bristles of the one or more brushes may contact the section/portion of the outer coating formed at the tips 34 of the coated razor blade edges 32 and may also extend between the coated razor blade edges 32 of adjacent razor blades 30 to contact the sections/portions of the outer coating formed on other areas of the coated razor blade edge 32. The tips of the bristles may be rounded to optimize removal of the outer coating.

In other examples, mechanically modifying the outer coating may comprise contacting the coated razor blade edges 32 with a mechanical modifying material 16, 116 comprising a plurality of lines or cords. The cords may be disposed substantially parallel to the coated razor blade edges 32, e.g., running in a direction indicated by arrow C in FIG. 3. A diameter of each cord may be substantially equal to a distance $D_{30}$ between the tips 34 of adjacent coated blade edges 32, as shown in FIGS. 1 and 2B, such that an individual cord contacts the outer coating formed on one side of each adjacent coated blade edge 32.

In further examples, mechanically modifying the outer coating may comprise contacting the coated razor blade edges 32 with a mechanical modifying material 216 comprising a fluid flow, as shown in FIG. 4. In some instances, the fluid flow may comprise one or more liquids such as water or alcohol. In other instances, the fluid flow may be a slurry comprising one or more liquids and one or more particles. The particles may comprise, for example, one or more of glass beads, ceramic powder, wood pulp, sand (e.g., calcium carbonate and/or silica), dehydrated silica gels, and hydrated aluminum oxides. A concentration of the slurry may be adjusted to achieve a desired amount of removal of the outer coating from the coated blade edges 32. In further instances, the fluid flow may comprise air, oxygen, or an inert gas such as argon. In all instances, the fluid flow may be pressurized. In addition, each fluid conduit 226-1, 226-2 may comprise a plurality of nozzles 220, and a shape, number, and/or distribution of the nozzles 228 may be altered to achieve a desired spray velocity and spray pattern and to achieve the desired angle of contact between the mechanical modifying material 216 and the coated razor blade edges 32, i.e., substantially parallel to the coated razor blade edges 32 (fluid conduit 226-1), substantially perpendicular to the coated razor blade edges 32 (e.g., fluid conduit 226-2), or any angle therebetween. One or more additional fluid conduits (not shown) may be used to apply the mechanical modifying material 216 at any desired angle with respect to the coated blade edges 32.

In all examples, as shown in the flow diagram 46 in FIG. 1, mechanical modification of the outer coating, e.g., the sintered polymer coating 42, of the coated razor blade edges 32 may at least partially remove a portion of the polymer from the coated razor blade edges 32 and/or push back a portion of the polymer away from the tip 34. In some instances, the mechanical modification may comprise thinning the outer coating 42. The mechanical modification may produce an outer coating 44, 44' with a substantially uniform thickness along at least a portion or section of the razor blade edge 32, particularly at or near the tip 34. Push back of the polymer may result in an outer coating 44' comprising a substantially uniform thickness at or near the tip 34, and some excess polymer of non-uniform thickness or pushback area 48 away from the tip (e.g., from having been pushed back from the tip 34) and remaining attached to the razor blade edge 32. In some instances, a surface area 32*b* covered by the outer coating 44, 44' after mechanical modification may be greater than a surface area 32*a* covered by the sintered polymer coating 42 (i.e., prior to mechanical modification). It should be noted that the prior art chemical modification process does not comprise pushing back the polymer or any excess polymer type regions on a razor blade edge as it does not involve any mechanical modifying action. The excess polymer 48 region shown in FIG. 1 on blade 32 is beneficial for comfort during shaving for sensitive users as it can provide a lift of the blade off the skin, enhancing shaving safety.

The razor blades 30 comprising the coated razor blade edges 32 may optionally undergo one or more chemical modifications of the outer coating, as indicated by steps 530 and 630 in FIGS. 5 and 6, respectively, after which the process may terminate. The chemical modification step(s) may occur prior to mechanical modification; after mechanical modification; or both. Chemical modification of the coated razor blade edges 32 may include application of one or more FLUTEC® solvents to remove a portion of the outer coating, as described in detail in U.S. Pat. Nos. 5,985,459 and 10,011,030.

Following modification (mechanical and optionally chemical) of the coated razor blade edges 32 as set out in FIGS. 5 and 6, the coated razor blade edges 32 may optionally undergo testing and/or additional processing as shown in FIG. 7. A cutting force of the coated razor blade edges 32 following modification may be measured by obtaining a wool felt cut (WFC) force value of the coated razor blade edges 32, with a wool felt cutter test as described herein and as indicated in step 740 in the flow diagram 700 of FIG. 7. The WFC cut force may be, for example, within a range of about 0.7 pounds to about 1.4 pounds. At step 750, it is determined whether the WFC cut force is below a predetermined threshold, e.g., below about 1.4 pounds. If "Yes," then the process may terminate. If "No," then further modification of the outer coating 44/44' of the coated razor blade edges 32 may be performed at step 760, which may include further mechanical modification, chemical modification, or both, as described in detail with respect to FIGS. 5 and 6. Steps 740-760 in FIG. 7 may be repeated one or more times until the WFC force obtained in step 740 is below the predetermined threshold.

Figure 8:
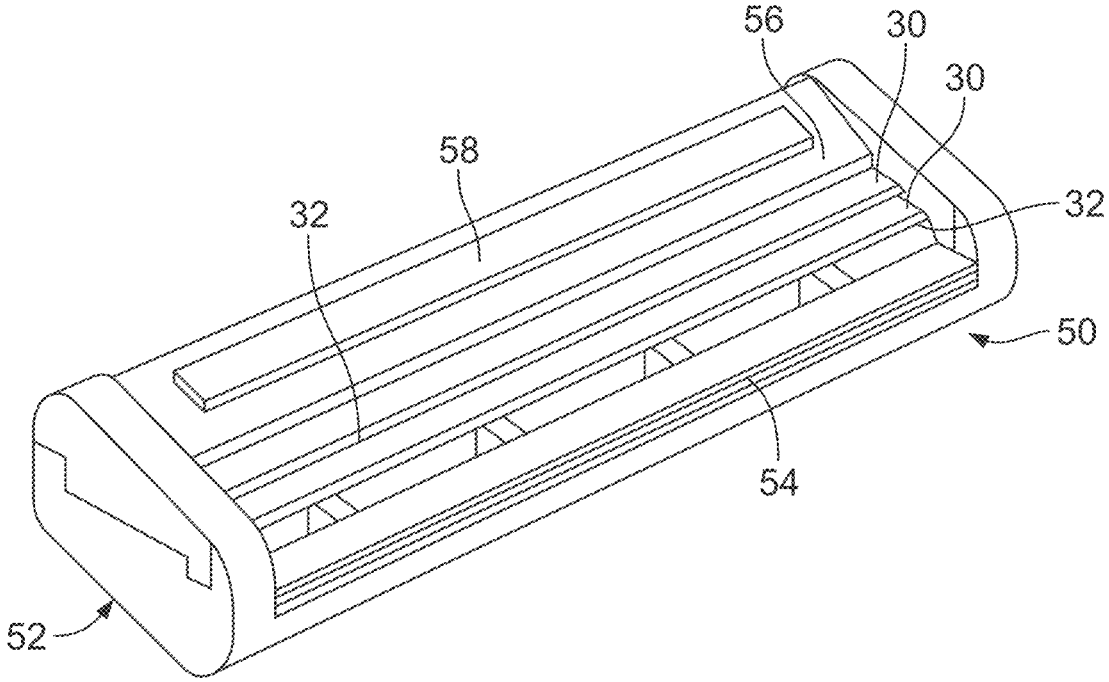
FIG. 8 is a perspective view of a razor cartridge comprising a razor blade edge with a modified coating in accordance with the present disclosure.

With reference to FIG. 8, one or more razor blades 30 comprising a razor blade edge 32 with a mechanically modified outer coating 44, 44' which may include pushback area 48 formed in accordance with the present disclosure may be incorporated into a razor cartridge 50, which may include a housing 52 with a guard structure 54 and a cap structure 56. The cap structure 56 may comprise a shaving aid 58 in the form of one or more lubricating and/or moisturizing strips. The razor cartridge 50 may be used integrally with a handle in a disposable razor in which the complete razor is discarded as a whole unit when the blade or blades become dulled, or may comprise a detachable razor cartridge that forms part of a shaving system, in which the detachable razor cartridge is uncoupled from a razor handle and disposed of but a new detachable razor cartridge is coupled to the same handle.

Razor blades with a mechanically modified outer coating formed in accordance with the present disclosure at least help to alleviate the "first shave" phenomenon by at least partially removing and/or pushing back excess polymer from the blade edge and tip prior to a first use. This mechanically modified outer coating is smoother, thinner, and more uniform and helps to reduce the cutting force and enhance overall user comfort, while avoiding many of the drawbacks of chemical treatment alone.

EXAMPLES

Example 1

Sample blade edges are sprayed with MP-1600 PTFE telomer powder using an electrostatic spray unit and are sintered at 350° C. in an inert atmosphere in a fluidized bath unit. Two of the coated and sintered blades are placed into the two blade-holders of an Advanced wool felt cutter for mechanical modification. Sheets of polystyrene foam (GATORFOAM®; International Paper Company) are cut into strips approximately 25.0 mm wide and 5 mm thick. The coated blades are mechanically modified by orthogonal cutting into the polystyrene foam strips using the following parameters:

Cutting depth: 1.25 mm

Approaching velocity: 10 mm/sec

Cut velocity: 3.0 mm/sec

Acceleration: 3.0 mm/sec$^2$

Figure 9:
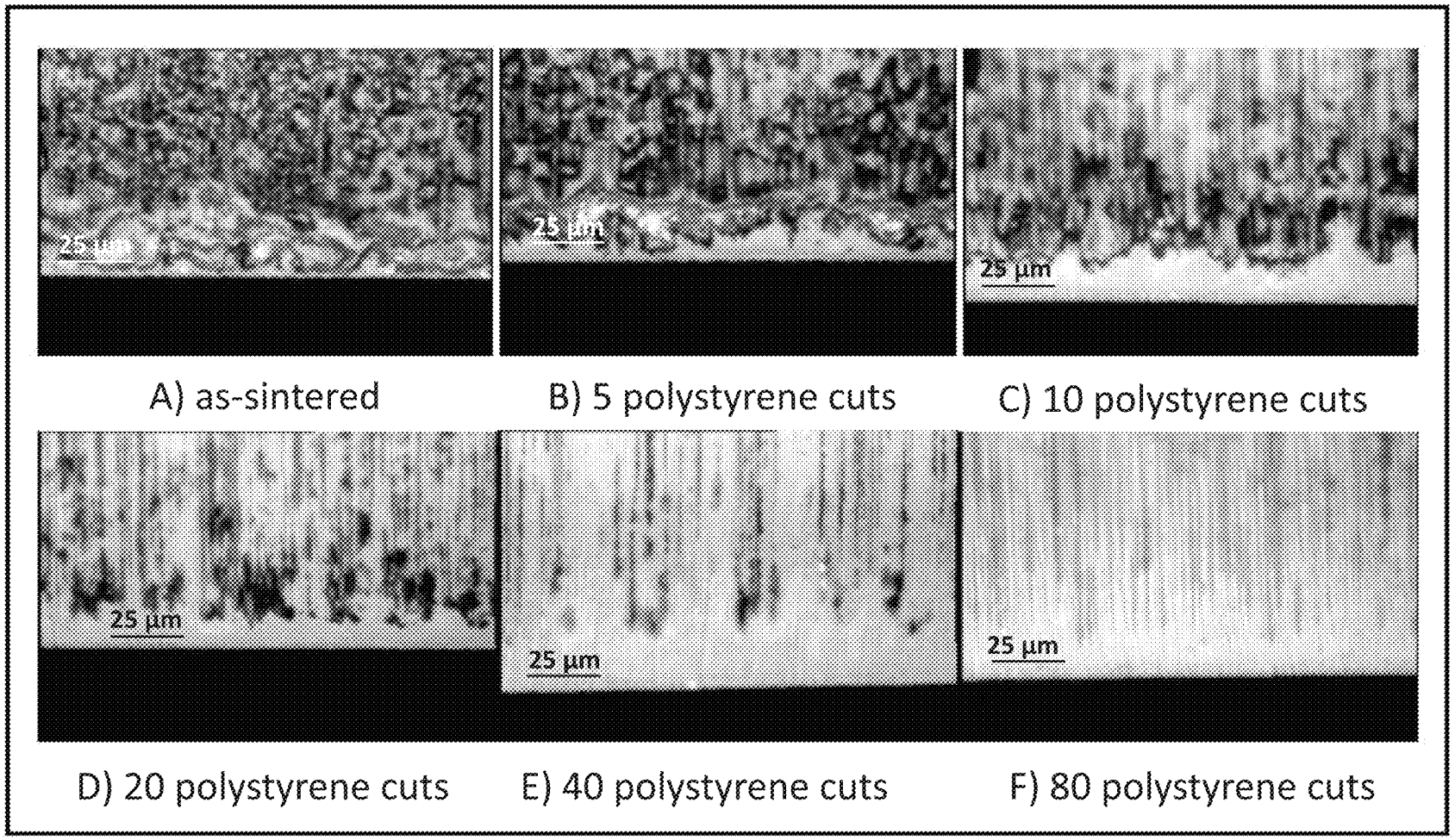
FIG. 9 is a series of photomicrographs of PTFE-coated razor blade edges following mechanical modification of the coated razor blade edges by cutting the blade edges onto a polystyrene foam strip.

Following mechanical modification, the coated razor blades are examined visually under optical microscopy. FIG. 9 shows a series of optical micrographs A) to F) of the PTFE-coated blades as-sintered and following a specified number of cuts into the polystyrene strips. After 10 cuts into the polystyrene strips, some evidence of mechanical modification in the form of telomer thinning and/or push back from the blade edge is evident. As the number of cuts is increased, the extent of the mechanical modification increases. As can be seen by FIGS. 9 (E) and (F), substantially all of the excess PTFE has been removed when compared to FIGS. 9 (A), (B), (C), and (D).

Example 2

Figure 10:
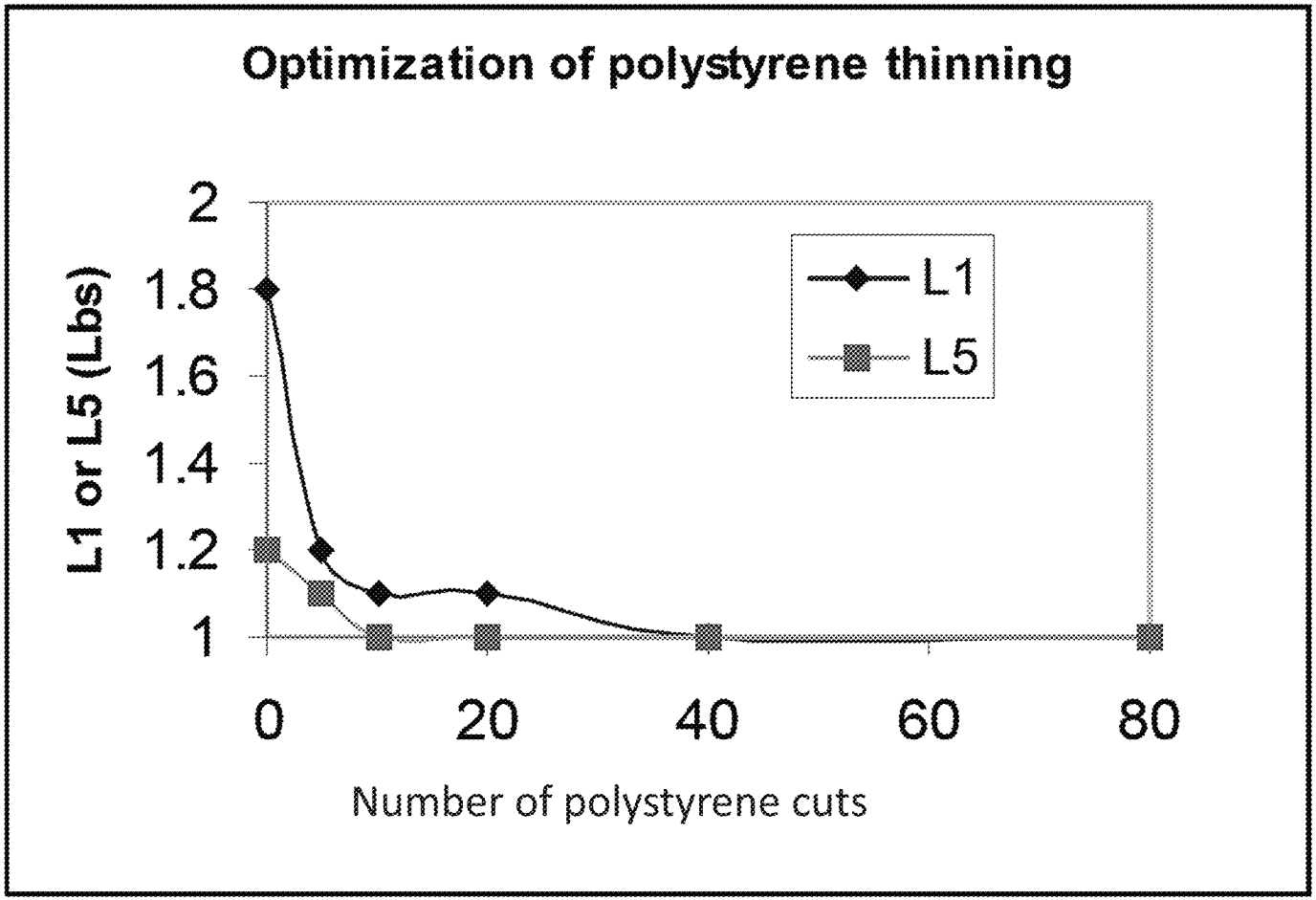
FIG. 10 is a graph illustrating a cutting force following a number of cuts into a polystyrene foam strip.

An optimum number of cuts into the polystyrene foam strips is determined by cutting the coated blades a fixed number of times onto the polystyrene strips as described in Example 1 and then measuring a cutting force using standard wool felt cutting techniques. FIG. 10 is a graph illustrating the results of WFC tests (five blades per group) of a single wool felt cut measurement of the blades that were mechanically modified with the polystyrene cuts. The as-sintered blades coated with MP-1600 show high L1 values. Five cuts through the polystyrene strips reduces the L1 value to 1.2 lb. Increasing the number of cuts to 10, 20, and 40 further reduces L1, but there is no significant improvement observed by doubling the number of cuts from 40 to 80 (although the visual appearance of the blades differs slightly). After 40 and 80 cuts through the polystyrene strips, the L1 values of the coated blades approximately equals the L5 values, which indicates a desired or thin telomer coating. Forty (40) cuts or more, through the polystyrene strips is designated as the optimal, minimum number of cuts for mechanically modifying an outer coating of blades coated in telomer to a desired state.

Example 3

A wool felt cutting test is performed on MP-1600 coated blades that are (i) mechanically modified with 40 cuts through a polystyrene strip as described in Examples 1 and 2; or (ii) treated with FLUTEC using a process described in U.S. Pat. No. 5,985,459. Untreated MP-1600 coated blades serve as a control. Table 1 below shows a comparison of the instrumentation performance.

The results of the FLUTEC-treated vs. the mechanically-modified blades are comparable.

TABLE 1

Instrumentation comparison between mechanically-modified and FLUTEC-treated blades (MP-1600)

| | Control MP-1600 | | | E1 Polystyrene 40 cuts | | | E2 FLUTEC | | |
|---|---|---|---|---|---|---|---|---|---|
| | Avg | StD | n | Avg | StD | n | Avg | StD | n |
| 1$^{st}$ Cut (lbs.) | 1.72 | 0.14 | 15 | 1.03 | 0.06 | 15 | 1.09 | 0.05 | 18 |
| L5 (lbs.) | 1.13 | 0.07 | 15 | 1.01 | 0.05 | 15 | 1.00 | 0.06 | 18 |
| Delta 500 (lbs) | 0.30 | 0.00 | 3 | 0.47 | 0.15 | 3 | 0.57 | 0.07 | 5 |

Example 4

Figure 11:
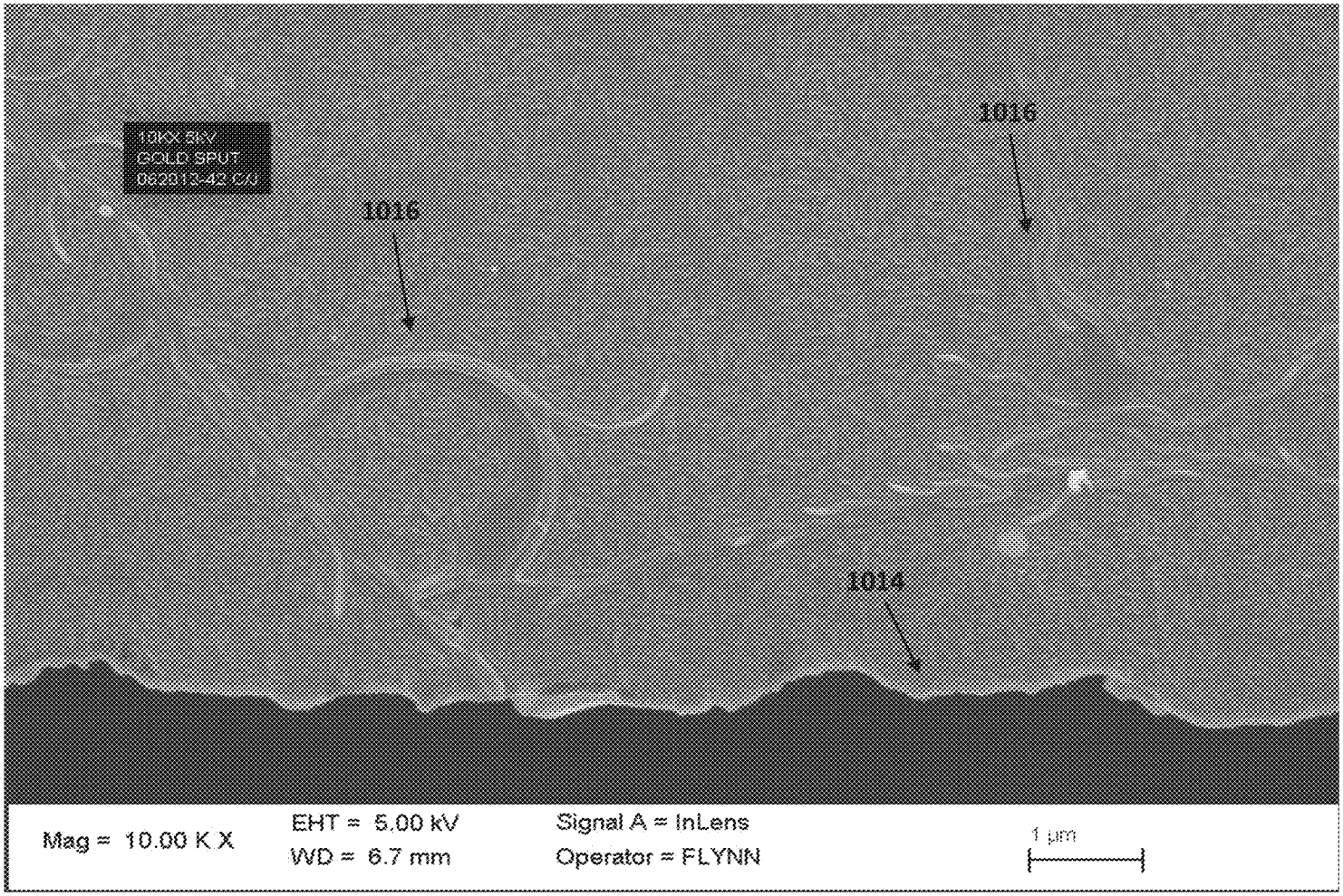
FIG. 11 is a photomicrograph of a PTFE-coated (MP-1600) razor blade edge that is prepared and treated with solvent.
Figure 12:
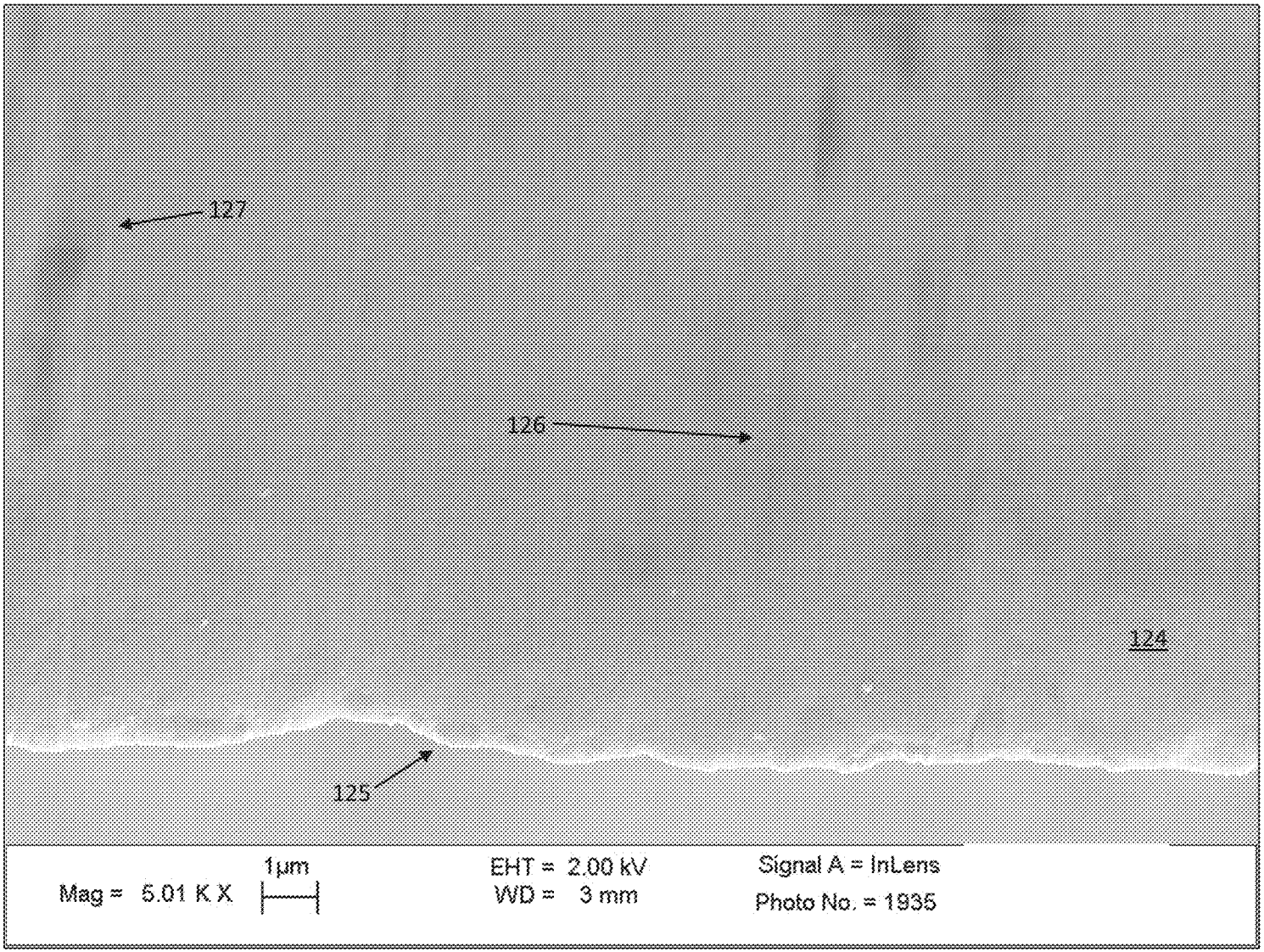
FIG. 12 is a photomicrograph of a PTFE-coated (MP-1600) razor blade edge that is mechanically modified in accordance with the present disclosure.

SEM images are obtained of razor blade edges that are coated with telomer (in this case of the MP-1600 type) and subsequently chemically treated or mechanically modified by wiping such as by wiping against or across surfaces of polystyrene material. FIG. 11 is a photomicrograph (magnification of 10.0 k×) of a PTFE-coated razor blade edge 1014 treated with FLUTEC. FIG. 12 is a photomicrograph (magnification of 5.01 k×) of a PTFE-coated razor blade edge 125 that is mechanically modified by wiping blades across the top surfaces of one or more polystyrene material. The blades were disposed at an angle of about 45 degrees relative to the top surface of the polystyrene material. While the instrumentation results are similar, the morphology is quite different. The mechanically-modified wiped blade 124 in FIG. 12 has a blade edge 125 with a smoother coating surface 126 and is nearly featureless under this magnification, except for wiping marks 127. As can be seen under the microscope, these wiping marks 127 have some orientation aligned with the wiping direction. The near featureless structure and smooth appearance of the blade coating mechanically modified by polystyrene can provide an enhanced benefit of lower friction during shaving. This can lead to a more comfortable and consistent shave. The FLUTEC-treated blade in FIG. 11 has features or texture that are believed to be the marks of liquid resolving including PTFE striations and fibrils 1016, which appear to have no preferential orientation. These striations and fibrils may increase the cutting force of hair resulting in minor discomfort during shaving.

Example 5

Sample blade edges are sprayed with LW-1200 PTFE telomer powder and sintered as described in Example 1. The coated razor blades are cut into polystyrene foam material as described in Example 1 and examined visually under optical microscopy. The cuts into the material are substantially orthogonal. Similar to the MP-1600 coated blades, the extent of mechanical modification in the form of telomer thinning and/or push back increased for the LW-1200 coated blades with an increased number of cuts into the polystyrene strips (data not shown). The coated blades are tested to determine an optimum number of cuts into the polystyrene foam material by cutting the blades a fixed number of times into the polystyrene strips and measuring a cutting force using standard WFC techniques, as described in Examples 1 and 2. The optimal, minimum number of cuts for thinning an outer coating of blades coated in LW-1200 is determined to be 10 cuts (data not shown).

Example 6

A WFC test is performed on LW-1200 coated blades that are (i) mechanically modified with 10 cuts through a polystyrene strip as described above; and (ii) treated with FLUTEC using a process described in U.S. Pat. No. 5,985,459. Untreated LW-1200 coated blades serve as a control. Table 2 below shows a comparison of the instrumentation performance. Again, the results of the FLUTEC-treated vs. the mechanically-modified blades are comparable.

TABLE 2

Instrumentation comparison between mechanically-modified and FLUTEC-treated blades (LW-1200)

| | Control LW-1200 | | | E1 Polystyrene 10 cuts | | | E2 FLUTEC | | |
|---|---|---|---|---|---|---|---|---|---|
| | Avg | StD | n | Avg | StD | n | Avg | StD | n |
| 1st Cut (lbs.) | 1.49 | 0.09 | 9 | 1.06 | 0.05 | 9 | 1.02 | 0.07 | 9 |
| L5 (lbs.) | 1.03 | 0.09 | 9 | 0.91 | 0.06 | 9 | 0.96 | 0.05 | 9 |
| Delta 500 (lbs) | 0.32 | 0.13 | 5 | 0.48 | 0.23 | 5 | 0.48 | 0.08 | 5 |

Example 7

Figure 13:
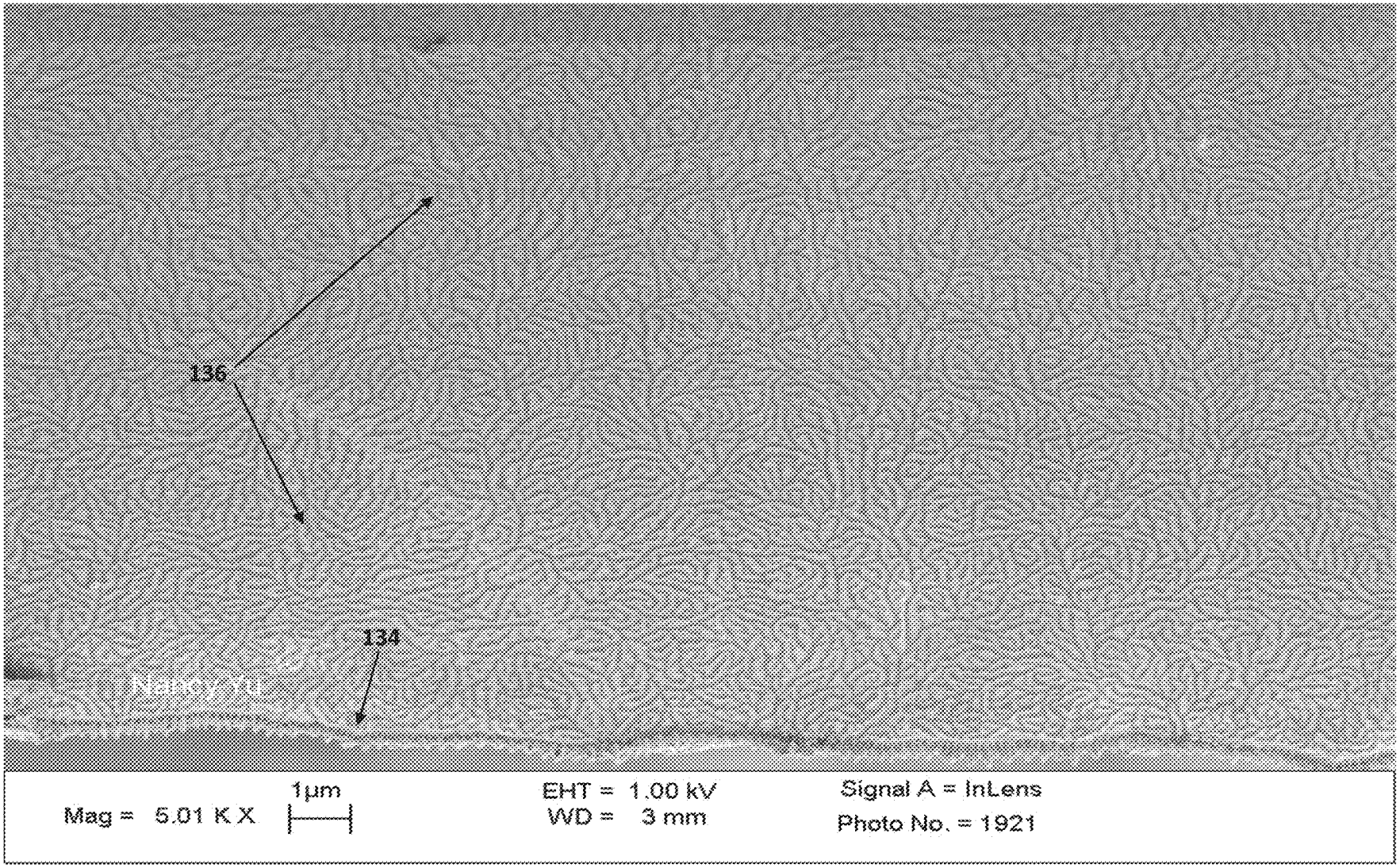
FIG. 13 is a photomicrograph of a PTFE-coated (LW-1200) razor blade edge that is prepared and treated with solvent.
Figure 14:
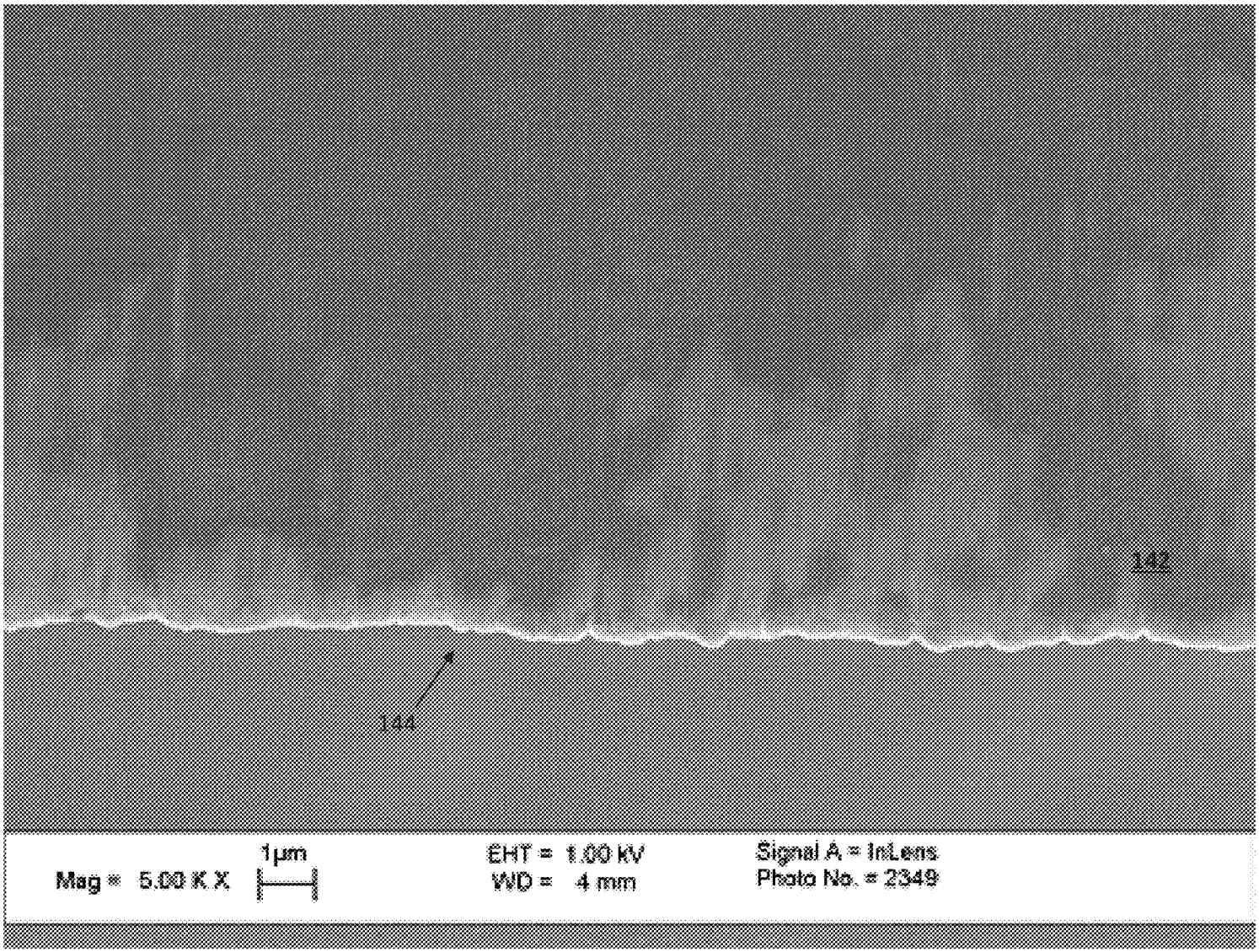
FIG. 14 is a photomicrograph of a PTFE-coated (LW-1200) razor blade edge that is mechanically modified in accordance with the present disclosure.

SEM images are obtained of razor blade edges that are coated with LW-1200 and chemically treated or mechanically modified as described in Example 6. FIG. 13 is a photomicrograph (magnification of 5.00 k×) of a PTFE-coated razor blade edge 134 that is treated with FLUTEC showing worm-shaped features which may be referred to as spirals or spiral-like features 136. FIG. 14 is a photomicrograph (magnification of 5.00 k×) of a PTFE-coated razor blade edge 144 that is mechanically modified by cutting into polystyrene strips. Similar to the MP-1600 coated blade edges, while the instrumentation results of the LW-1200 coated blade edges are similar, the morphology is quite different. The blade 142 mechanically wiped across polystyrene in FIG. 14 has a desirably smoother surface with little to no features under this magnification and resembles the blade edge with the mechanically-modified MP-1600 coating in FIG. 12. The FLUTEC-treated blade in FIG. 13 is similar to the FLUTEC-treated blade in FIG. 11 and has textured features with no apparent orientation.

Example 8

Figure 15A:
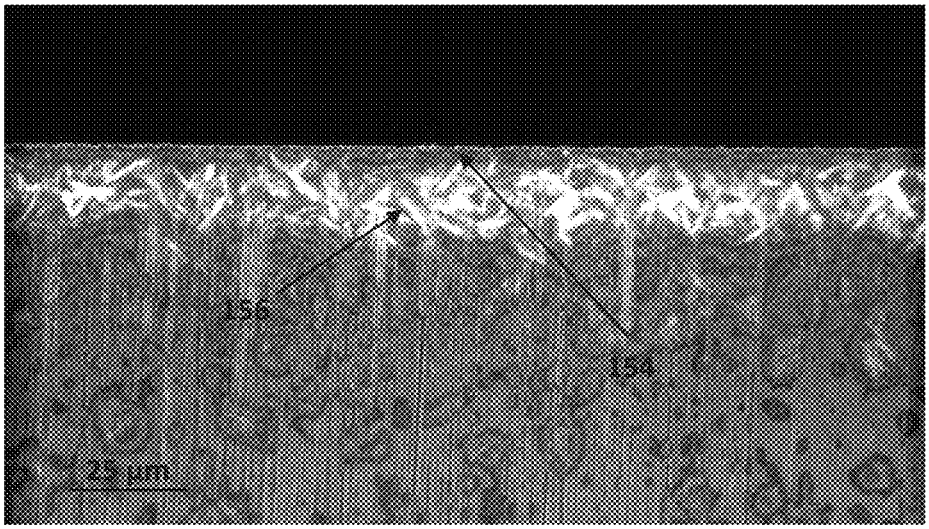
FIG. 15A is a photomicrograph of a PTFE-coated razor blade edge prior to any treatment or modification.
Figure 15B:
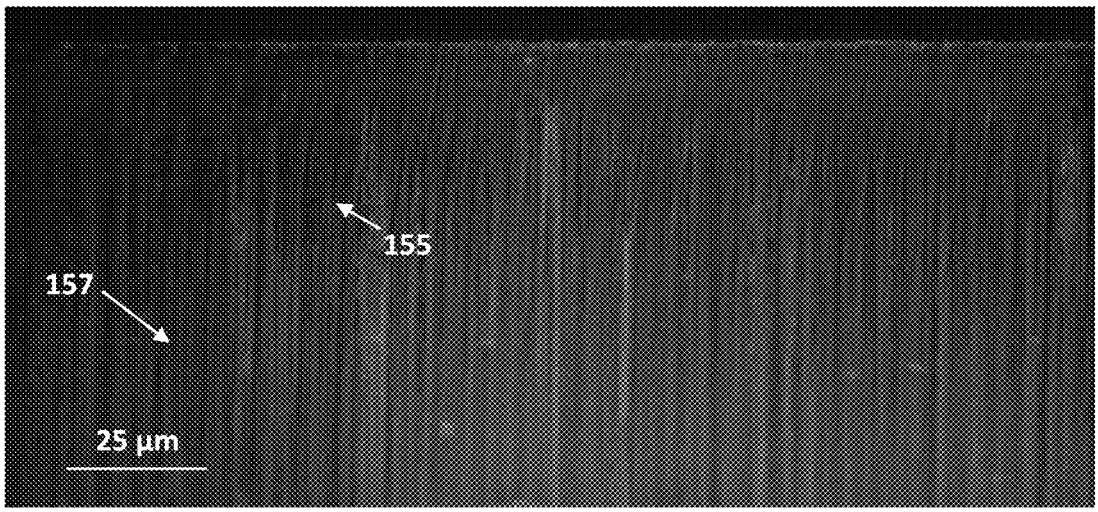
FIG. 15B is a photomicrograph of a PTFE-coated razor blade edge that is prepared and treated with solvent.
Figure 16:
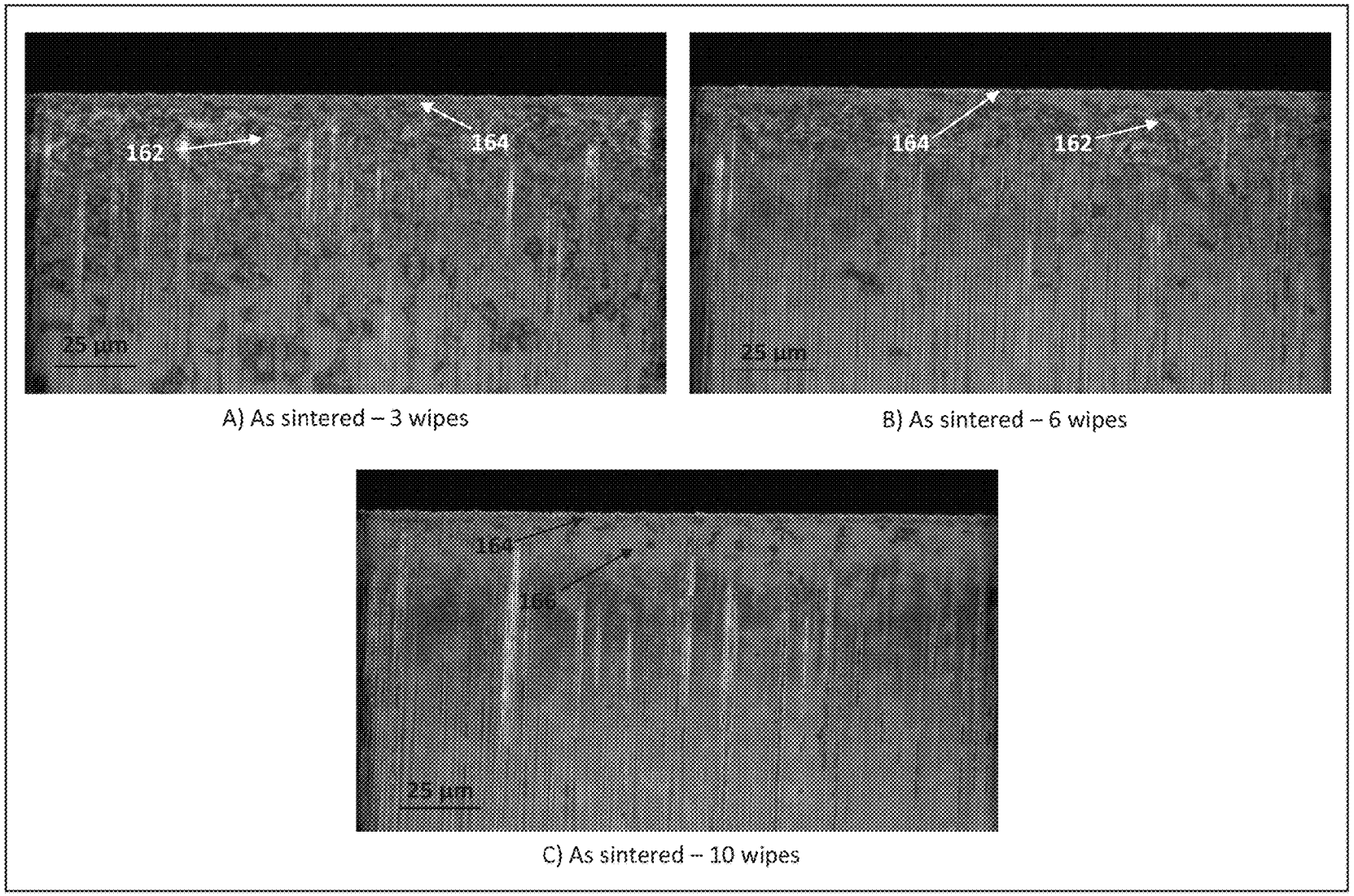
FIG. 16 shows a series of micrographs of PTFE-coated razor blade edges following mechanical modification in accordance with the present disclosure.

SEM images were obtained of razor blade edges that are coated with LW-2120 and sintered as described in Example 1; and (i) chemically treated with FLUTEC using a process described in U.S. Pat. No. 5,985,459; or (ii) mechanically modified, in which the mechanical modification comprises wiping the PTFE-coated edges, from left to right, through polystyrene foam material. FIGS. 15A, 15B, and 16 are optical micrographs (750× magnification) of PTFE-coated razor blade edges prior to or following treatment/modification. FIG. 15A shows a PTFE-coated razor blade edge 154 as sintered prior to any treatment or modification (virgin), which comprises a thick telomer coating 156 near the blade edge 154. FIG. 15B shows a PTFE-coated razor blade edge 155 following chemical treatment with FLUTEC. As can be seen in FIG. 15B, there is a thinned telomer coating 157 but there is no push back zone. FIG. 16 shows a series of micrographs A) to C) of a PTFE-coated razor blade edge 164 following mechanical modification by wiping polystyrene foam three, six, and ten times, respectively. Ten wipes generates a thinned telomer coating 166 near the blade edge 164. A push back zone 162 is visible in the mechanically modified blade coatings, in which a portion of the telomer coating has been pushed back from the blade edge.

These examples demonstrate development of methods and apparatuses for reproducibly producing mechanically-modified telomer coatings on razor blade edges. In addition, these results point to a link between an increase in shaving comfort and the thinning and smoothing of the treated coating (e.g., an outer coating). It was previously unknown whether the increase in shaving comfort with FLUTEC-thinned blades was due to the thinning of the outer coating, changes in morphology and other properties of the coating due to the FLUTEC treatment, or a combination of both factors. While the mechanically-modified razor blade edges have comparable instrumentation results as compared to FLUTEC-thinned razor blade edges, the mechanically-modified telomer coating has a different morphology from chemically-thinned coating that is distinguishable under the microscope. As described, generally the FLUTEC-thinned razor blade edges show distinct structures comprising some texture whereas the mechanically-modified coating were substantially devoid of texture, the latter which may be due to mass alignment of the Telomer.

Representative embodiments of the present disclosure described above can be described as follows:

A. A method of modifying razor blade edges prior to a first use, the method comprising:

providing at least one razor blade having a coated razor blade edge; and mechanically modifying at least one coating of said coated razor blade edge.

B. The method of paragraph A, wherein mechanically modifying said at least one coating comprises wiping said coated razor blade edge with a mechanical modifying material.

C. The method of paragraph B, wherein said wiping is performed substantially parallel to said coated razor blade edge.

D. The method of paragraphs B or C, wherein said wiping comprises rubbing, spreading, dabbing, sponging, swabbing, polishing, distributing, or any combination thereof.

E. The method of any of paragraphs A to D, wherein mechanically modifying said at least one coating comprises contacting the coated razor blade edge with a mechanical modifying material comprising a foam, rubber, wood, paper, textiles, leather, elastomers, cork, a pressurized fluid flow, a slurry, or any combination thereof.

F. The method of paragraph E, wherein said foam comprises a polystyrene foam sheet, a foam sponge, or any combination thereof.

G. The method of paragraphs E, wherein said leather comprises a chamois leather.

H. The method of any of paragraphs E to G, wherein said mechanical modifying material is disposed on a material support.

I. The method of paragraph H, wherein said material support is stationary.

J. The method of paragraph H, wherein said material support comprises a rotating wheel, a rotating block, a revolving tool, or a combination thereof.

K. The method of any of paragraphs A to J, wherein mechanically modifying said at least one coating comprises contacting the coated razor blade edge with a mechanical modifying material comprising one or more plant-based materials.

L. The method of any of paragraphs A to K, wherein said at least one coating comprises a polymeric material.

M. The method of paragraph L, wherein said polymeric material comprises a fluoropolymer.

N. The method of any of paragraphs A to M, wherein said at least one razor blade is arranged on a blade stack.

O. The method of any of paragraphs A to N, further comprising obtaining a wool felt cut force value of said coated razor blade edge after mechanical modification.

P. The method of paragraph O, wherein said wool felt cut force value is within a range of about 0.7 pounds to about 1.4 pounds.

Q. The method of paragraphs O or P, further comprising wherein when the wool felt cut force value is above a predetermined value, further modifying said at least one coating of the one or more coated razor blade edge by mechanical modification, chemical modification, or both.

R. The method of any of paragraphs A to Q, wherein providing at least one razor blade having a coated razor blade edge comprises:

spraying a dispersion on at least one uncoated razor blade to form a coated razor blade; and sintering said coated razor blade to form said at least one razor blade with at least one coating adhered to said coated razor blade edge.

S. The method of any of paragraphs A to R, wherein said mechanical modification partially removes said at least one coating.

T. The method of any of paragraphs A to S, further comprising chemically modifying said at least one coating, wherein said chemical modification occurs prior to said mechanical modification, after said mechanical modification, or both.

U. The method of any of paragraphs A to T, wherein mechanically modifying said at least one coating comprises thinning said outer coating.

V. The method of any of paragraphs A to U, wherein mechanically modifying said at least one coating comprises contacting said coated razor blade edge with a mechanical modifying material such that said coated razor blade edge at least partially cut through or wipes onto said mechanical modifying material.

W. The method of paragraph A, wherein mechanically modifying said at least one coating comprises contacting said coated razor blade edge with one or more brushes.

X. The method of paragraph A, wherein mechanically modifying said at least one coating comprises contacting said coated razor blade edge with a plurality of cords disposed substantially parallel to said coated razor blade edge.

Y. An apparatus for modifying one or more coated razor blade edges, the apparatus comprising:

a support member for holding a plurality of razor blades with said coated razor blade edges; and an applicator for contacting a mechanical modifying material with at least a section of said coated razor blade edges.

Z. The apparatus of paragraph Y, wherein said applicator comprises a material support, said material support being movable relative to said support member.

AA. The apparatus of paragraph Z, wherein said material support is a rotating block, a rotating wheel, a revolving tool, or a combination thereof.

BB. The apparatus of any of paragraphs Y to AA, wherein said applicator comprises a stationary material support.

CC. The apparatus of any of paragraphs Y to BB, wherein said applicator contacts said mechanical modifying material with said coated razor blade edges in a direction substantially parallel to said coated razor blade edges.

DD. The apparatus of paragraph CC, wherein said contact is a wiping action.

EE. The apparatus of paragraph DD, wherein said wiping action partially removes at least one coating on said coated razor blade edges.

FF. The apparatus of any of paragraphs CC to EE, wherein said contact comprises contacting said coated razor blade edges with said mechanical modifying material such that said coated razor blade edges at least partially cut through or wipes onto said mechanical modifying material.

GG. The apparatus of paragraph CC, wherein said contact comprises contacting said coated razor blade edges with one or more brushes.

HH. The apparatus of paragraph CC, wherein said contact comprises contacting said coated razor blade edges with a plurality of cords disposed substantially parallel to said coated razor blade edges.

II. The apparatus of any of paragraphs Y to HH, wherein said plurality of razor blades comprises a blade stack comprising up to about 4000 razor blades.

JJ. The apparatus of any of paragraphs Y to FF and paragraph II, wherein said mechanical modifying material comprises a foam, wool felt, rubber, wood, paper, textiles, leather, elastomer, cork, a pressurized fluid flow, or any combination thereof.

KK. A razor blade comprising a razor blade edge with a mechanically modified at least one coating formed in accordance with the method of any of paragraphs A to X.

LL. A razor cartridge comprising at least one razor blade having a mechanically modified at least one coating formed in accordance with the method of any of paragraphs A to X.

MM. A method of modifying razor blade edges prior to a first use, the method comprising:

providing at least one razor blade having a coated razor blade edge comprising at least one coating; and wiping said coated razor blade edge with at least one mechanical modifying material.

NN. The method of paragraph NN, wherein wiping said coated razor blade edge with said at least one mechanical modifying material comprises smearing, cleaning, rubbing, drying, polishing, dabbing, streaking, or any combination thereof.

OO. The method of paragraph MM or NN, wherein said at least one mechanical modifying material comprises a foam, wool felt, rubber, wood, paper, textiles, leather, elastomer, cork, or any combination thereof.

PP. The method of any of paragraphs MM to OO, wherein said at least one mechanical modifying material is disposed on a material support.

QQ. The method of paragraph PP, wherein said material support is stationary.

RR. The method of paragraph PP, wherein said material support is a rotating wheel, a rotating block, a revolving tool, or a combination thereof.

SS. The method of any of paragraphs MM to RR, further comprising obtaining a wool felt cut force value of said coated razor blade edge after said wiping.

TT. The method of paragraph SS, further comprising wherein when the wool felt cut force value is above a predetermined value, further modifying said at least one coating of the coated razor blade edge by mechanical modification, chemical modification, or both.

UU. The method of paragraphs SS or TT, wherein said wool felt cut force value is within a range of about 0.7 pounds to about 1.4 pounds.

VV. The method of any of paragraphs MM to UU, wherein said wiping partially removes said at least one coating.

WW. The method of any of paragraphs MM to VV, wherein providing at least one razor blade having a coated razor blade edge comprises:

spraying a dispersion on at least one uncoated razor blade to form a coated razor blade; and sintering said coated razor blade to form said at least one razor blade with at least one coating adhered to said coated razor blade edge.

XX. The method of any of paragraphs LL to WW, wherein mechanically modifying said outer coating comprises thinning said at least one coating.

YY. The method of any of paragraphs LL to XX, further comprising chemically modifying said at least one coating, wherein said chemical modification occurs prior to said wiping, after said mechanical wiping, or both.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of modifying razor blade edges, the method comprising:

providing at least one razor blade having a coated edge; and mechanically modifying at least one coating of said coated razor blade edge, wherein mechanically modifying said at least one coating comprises contacting said coated razor blade edge with a plurality of cords.

2. The method of claim 1, wherein the plurality of cords are disposed substantially parallel to said coated razor blade edge.

3. The method of claim 1, wherein said at least one coating is an outer coating.

4. The method of claim 1, wherein a plurality of razor blades having a coated edge are arranged adjacent to one another on a blade stack.

5. The method of claim 4, wherein the diameter of each cord is substantially equal to the distance between the tips of adjacent coated blade edges such that an individual cord contacts the outer coating formed on one side of each adjacent coated blade edge.

6. The method of claim 1, wherein said at least one coating comprises a polymeric material.

7. The method of claim 6, wherein said polymeric material comprises a fluoropolymer.

8. The method of claim 1, further comprising obtaining a wool felt cut force value of said coated razor blade edge after mechanical modification.

9. The method of claim 8, wherein said wool felt cut force value is within a range of about 0.7 pounds to about 1.4 pounds.

10. The method of claim 8, further comprising wherein when the wool felt cut force value is above a predetermined value, further modifying said at least one coating of the one or more coated razor blade edge by mechanical modification, chemical modification, or both.

11. The method of claim 1, wherein providing at least one razor blade having a coated razor blade edge comprises:

spraying a dispersion on at least one uncoated razor blade to form a coated razor blade; and sintering said coated razor blade to form said at least one razor blade having a coated edge.

12. The method of claim 1, wherein mechanically modifying said at least one coating comprises thinning said at least one coating.

13. The method of claim 1, wherein said mechanical modification partially removes said at least one coating.

14. The method of claim 1, further comprising chemically modifying said at least one coating, wherein said chemically modifying occurs prior to said mechanically modifying, after said mechanically modifying, or both.

15. The method of claim 1, wherein said mechanically modifying said at least one coating occurs prior to a first use.

* * * * *